US005719623A

United States Patent [19]

Kinoshita

[11] Patent Number: 5,719,623

[45] Date of Patent: Feb. 17, 1998

[54] STREAK TUBE

[75] Inventor: Katsuyuki Kinoshita, Hamamatsu, Japan

[73] Assignee: Hamamatsu Photonics K.K., Hamamatsu, Japan

[21] Appl. No.: 785,829

[22] Filed: Jan. 15, 1997

Related U.S. Application Data

[63] Continuation of Ser. No. 633,005, Apr. 16, 1996, abandoned, which is a continuation of Ser. No. 210,760, Mar. 22, 1994, abandoned.

[30] Foreign Application Priority Data

Mar. 23, 1993 [JP] Japan ..... 5-064113

[51] Int. Cl.[6] ..... H01J 15/30

[52] U.S. Cl. ..... 348/215; 313/379

[58] Field of Search ..... 313/379; 250/214 VT; 348/215

[56] References Cited

U.S. PATENT DOCUMENTS

| | | | |
|---|---|---|---|
| 3,043,910 | 7/1962 | Hicks, Jr. | 348/804 |
| 3,240,987 | 3/1966 | Hicks, Jr. | 315/8.61 |
| 3,387,137 | 6/1968 | Adams | 250/214 VT |
| 3,424,909 | 1/1969 | Rougeot | 250/207 |
| 3,534,219 | 10/1970 | Newberry | 315/391 |
| 3,602,903 | 8/1971 | Requa | 356/141.5 |
| 3,628,080 | 12/1971 | Lindequist | 315/239 |
| 3,919,588 | 11/1975 | Parks et al. | 315/14 |
| 3,936,693 | 2/1976 | Parks et al. | 313/427 |
| 4,196,373 | 4/1980 | Parks | 315/14 |
| 4,350,919 | 9/1982 | Johnson et al. | 313/529 |
| 4,467,189 | 8/1984 | Tsuchiya | 250/214 VT |
| 4,585,948 | 4/1986 | Schneider et al. | 250/208.1 |
| 4,611,124 | 9/1986 | Schneider | 250/208.1 |
| 4,645,918 | 2/1987 | Tsuchiya et al. | 250/214 VT |
| 4,906,833 | 3/1990 | Miyawaki et al. | 250/214 LS |
| 4,958,231 | 9/1990 | Tsuchiya | 348/215 |
| 5,013,902 | 5/1991 | Allard | 250/214 VT |
| 5,017,829 | 5/1991 | Koishi et al. | 313/382 |
| 5,101,100 | 3/1992 | Kinoshita et al. | 250/214 VT |
| 5,111,035 | 5/1992 | deLuca | 250/214 VT |
| 5,268,570 | 12/1993 | Kim | 250/214 VT |
| 5,278,403 | 1/1994 | Alfano et al. | 250/214 VT |
| 5,304,791 | 4/1994 | Migliaccio | 250/214 VT |
| 5,381,000 | 1/1995 | McKee, Jr. | 250/214 VT |

FOREIGN PATENT DOCUMENTS

| | | | |
|---|---|---|---|
| 2172740 | 9/1986 | United Kingdom | H01J 31/50 |

OTHER PUBLICATIONS

Niu et al, "Picosecond Framing Technique Using a Conventional Streak Camera", Rev. Sci. Instrum. 52(8), Aug. 1981, pp. 1190–1192.

Lieber et al, "Picosecond Framing Camera Using a Passive Microchannel Plate", Rapid Communications, vol. 18, No. 6, Applied Optics, pp. 745–746.

Cheng et al, "Fiber Array Technique for Subnanosecond X-Ray Framing Camera", SPIE, vol. 97, High Speed Photography (Toronto 1976), pp. 218–222.

*Primary Examiner*—Mark R. Powell

*Attorney, Agent, or Firm*—Cushman Darby & Cushman IP Group of Pillsbury Madison & Sutro LLP

[57] ABSTRACT

A streak tube the total length of which is short. An optical image of an object is converted into a plurality of divided micro incident electronic images by converting means and photoelectrons from these divided micro incident electronic images are focused by a focusing electron lens. Further, the photoelectrons are swept by a deflecting means and imaged on an output plane. Thus, the optical image of the object is converted into the divided micro incident electronic images, so that focusing and sweeping can be performed in short distance. Accordingly, the total length of the tube can be short.

17 Claims, 26 Drawing Sheets

STREAK TUBE

This is a continuation of application Ser. No. 08/633,005, filed on Apr. 16, 1996, which was abandoned upon the filing hereof and which was an FWC of application Ser. No. 08/210,760, filed Mar. 22, 1994, which was abandoned upon the filing thereof.

BACKGROUND OF THE INVENTION

1. Field of the Invention

The present invention relates to a streak tube which can measure time-variation of an object or an image of which the shape or the lightness is varied at high speed.

2. Related Background Art

A conventional streak tube which can obtain information of the time concerning a two-dimensional image is disclosed in the reference "Rev. Sci Instrum 52 (8). August 1981 p.1190–1192". Referring to FIG. 24, a configuration of the conventional streak tube will be explained. As shown in FIG. 24, the conventional streak tube comprises an optical mask 102 and an optical lens 103 in front of a photocathode 101, and a mesh accelerating electrode 104, a focusing lens 105, deflecting electrodes 106 and 107, and an output phosphorous screen 108 in the rear of the photocathode 101. A two-dimensional optical image of an object to be measured which has entered the streak tube is divided into micro-images through the optical mask 102, and the divided micro-images are formed on the photocathode 101. Then, photoelectron beams emitted from the photocathode 101 are swept by the deflecting electrodes 106 and 107, and a streaking image of each divided micro-image (pixel) is formed on the output phosphor screen 108.

SUMMARY OF THE INVENTION

In this case, since the entering optical image of the object is 5–10 mm in size, in order to form the streaking image corresponding to the optical image of the object on the output phosphorous screen, regarding a spherical aberration and so forth, a focusing electron lens having a diameter a few times larger than the size of the optical image of the object is needed. And the length of the focusing electrode system in a direction of the tube-axis corresponding to the focusing electron lens is five to six times larger than a diameter of the focusing electron lens. Therefore, the total length of the streak tube becomes long, i.e., 200 mm–300 mm. Further, because the total length of the streak tube is long, running time of the photoelectron therethrough is large, and the blur of the optical image of the object having high lightness becomes large due to a space-charge effect. Further, photoelectric currents emitted in accordance with the total optical image are crossed in the vicinity of an anode aperture 109, and the photoelectric current density becomes large, so that the blur of the image becomes large also due to the space-charge effect.

Further, the photoelectrons emitted from the different positions on the photocathode 101 pass through the different positions on the focusing lens 105, so that it is a fault that geometric distortion of the streaking image becomes large depending on the aberration of the lens.

It is an object of the present invention to provide a streak tube in which the faults on characteristics as described above are solved and the total length of which is short.

In order to solve the above problems, a streak tube of the present invention comprises converting means for converting an optical image of an object into a two-dimensional arrayed image including a plurality of divided micro-incident electronic spots, which will be hereinafter referred to as micro-incident electronic images. The invention further includes a focusing electron lens comprising a plurality of focusing electrode plates, each having a plurality of apertures arrayed corresponding to each divided micro-incident electronic image formed by the converting means, the focusing electrode plates jointed to each other with the apertures aligned, for focusing photoelectrons from the divided micro-incident electronic images by making the photoelectrons pass through each aperture, deflecting means having a configuration of teeth parts of one pair of comb-like deflecting electrodes engaging each other, for deflecting photoelectrons from each divided micro-incident electronic image by transmitting photoelectrons through between the teeth of the deflecting electrode, and an output plane for imaging photoelectrons passing through the deflecting means.

Here, the converting means may comprise dividing means for dividing the optical image of the object into a plurality of divided micro-optical images, and a photocathode for converting each divided micro-optical image divided by the dividing means into a corresponding divided micro incident electronic image. Alternatively, the converting means may comprise a photocathode for converting the optical image of the object into photoelectrons of the object, and dividing means for dividing the photoelectrons of the object emitted from the photocathode into a plurality of divided micro-incident electronic images.

FIG. 25 shows general ideas of the present invention. Referring to FIG. 25, the operation of the present invention will be explained hereunder. First, an optical image of an object incident on a converting means 110 is converted into a plurality of divided micro-incident electronic images including pixels separated with a predetermined spacing and then emitted. These photoelectrons from the divided micro-incident electronic images are focused by passing through each aperture of a focusing electron lens 111, and further they are swept by passing through a deflecting means 112 and are re-formed on an output plane 113.

In the deflecting means 112, photoelectrons are swept within a range of the spacing of each divided micro incident electronic image, so that a luminous distribution corresponding to the time-variation of the strength of each pixel of the divided micro-incident optical image generates along in a sweeping direction. The size of the divided micro-incident electronic images is small, for example, a 10 μm diameter, so that a diameter of a corresponding focusing electron lens 111 is also small. Accordingly, the length of the focusing electron lens 111 in a tube axis direction may be short. Further, the size of each output image generated on the output plane 113 is also small, e.g., 10 μm, so that the deflecting distance is short, and the distance between the deflecting means 112 and the output plane 113 may be short. Accordingly, the total length of the tube can be extremely short.

Further, according to the present invention, photoelectrons from the divided micro-incident electronic images emitted from the converting means 110 are already divided into pixels when the photoelectrons enter the deflecting means 112, so that the blur of the image does not occur when the inclined voltage is applied to the deflecting means 112 and the gate operation of the photoelectron flow is not needed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

FIG. 5A is a voltage diagram illustrating a voltage to be applied to the streak tube of FIG. 5.

DESCRIPTION OF THE PREFERRED EMBODIMENT

Embodiments of the present invention will be described hereunder with reference to the accompanying drawings.

Figure 1:
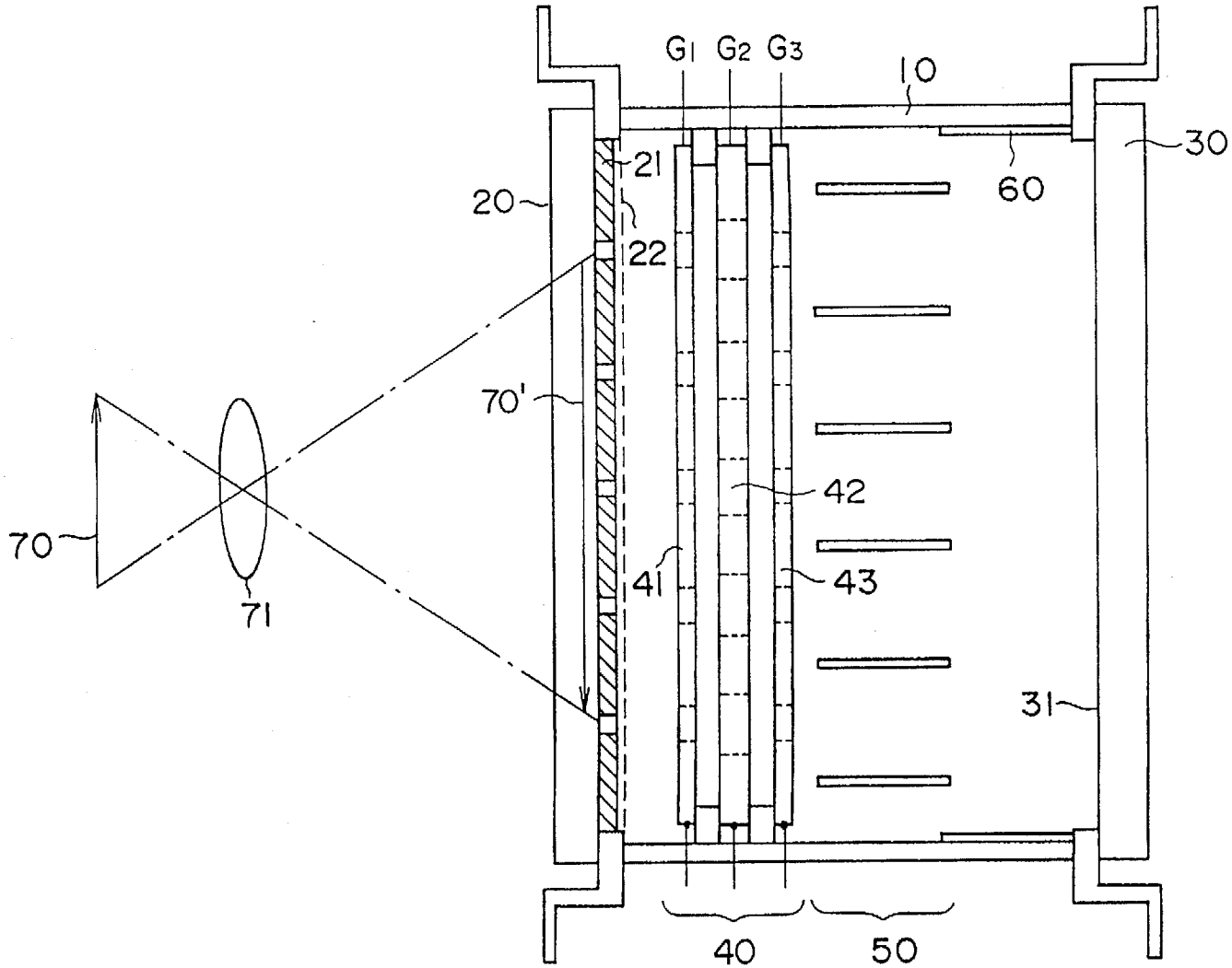
FIG. 1 is a side sectional view showing a configuration of a streak tube according to the present embodiment.

FIG. 1 is a side sectional view showing a configuration of the present embodiment. Referring to FIG. 1, in a streak tube according to the present embodiment, two apertures of a cylindrical glass tube 10 are closed by glass plates, and one of the glass plates is an entrance window 20, and the other is an exit window 30. An optical mask 21 is deposited at the internal surface of the entrance window 20. The optical mask 21 is of A1 that is deposited to few thousands Å in thickness and apertures having a diameter of 20 μm are holed therein with a 0.5 mm spacing into a matrix shape in a range of 100 mm×100 mm valid area of a photocathode by etching with resist. In the drawings, some apertures are omitted and the other apertures are shown and are scaled-up. Further, an S-20 photocathode 22 is formed on the internal surface of the optical mask 21. Moreover, a phosphorous screen 31 is formed on the internal surface of the exit window 30.

A micro-focusing electron lens 40 comprising a plurality of disk-type electrodes (see FIG. 2B) and a deflecting electrode 50 comprising a pair of comb-like electrodes are placed between the entrance window 20 and the exit window 30. That is, the micro-focusing electron lens 40 is placed about 1.5 mm behind the photocathode 22 of the entrance window 20, and the deflecting electrode 50 is placed about 1.5 mm behind the micro-focusing electron lens 40, and the space between the deflecting electrode 50 and the phosphorous screen 31 is about 15 mm.

Further, a wall electrode 60 is deposited on the wall of the tube between the deflecting electrode 50 and the exit window 30 to prevent electric charge up. The wall electrode 60 is electrically connected to a flange of the phosphor screen 31 in the tube.

Figure 2A:
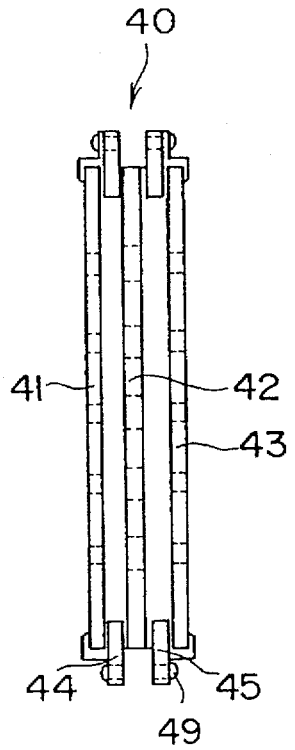
FIGS. 2A and 2B are sectional views showing configurations of a micro-focusing electron lens.
Figure 2B:
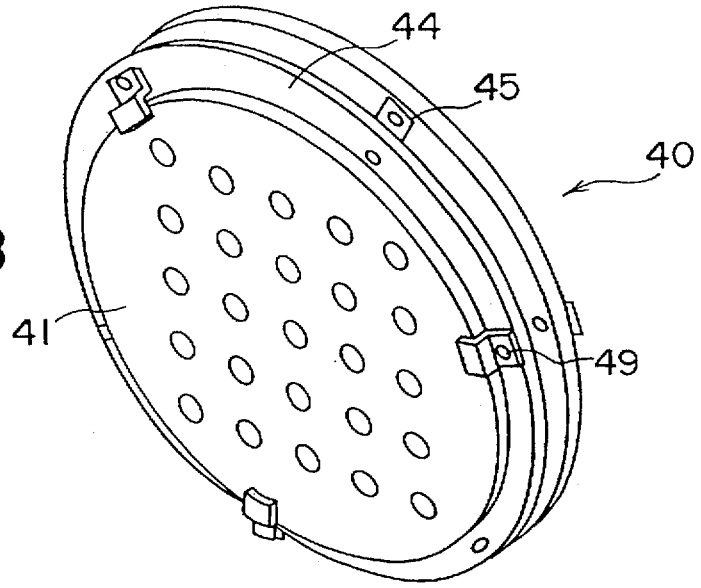

FIG. 2A is a sectional view showing a configuration of the micro-focusing electron lens 40, and FIG. 2B is a perspective view showing the appearance of the micro-focusing electron lens 40. As shown in FIG. 2A, the micro-focusing electron lens 40 comprises a $G_1$ electrode 41, a $G_2$ electrode 42, and a $G_3$ electrode 43, and insulating rings 44 and 45 made of 1 mm thick ceramic, which are put between the electrodes. The $G_1$ electrode 41, $G_2$ electrode 42 and $G_3$ electrode are stainless metal plates having a 1 mm thickness, a 2.5 mm thickness, and a 1 mm thickness, respectively, and the $G_1$ electrode 41 and $G_3$ electrode 43 have apertures having a diameter of 0.1 mm holed with a 0.5 mm spacing in a range of 100 mm×100 mm, and the $G_2$ electrode 42 has apertures having a diameter of 0.15 mm holed with a 0.5 mm spacing in a range of 100 mm×100 mm.

Further, as shown in FIG. 2B, metal pins are bedded around the insulating rings 44 and 45, and metallic parts for fixation are welded to these metal pins. The electrodes and the insulating rings are jointed by the metallic parts for fixation. Further, the centers of the apertures of each electrode are adjusted to align at the time of fixation.

Figure 3A:
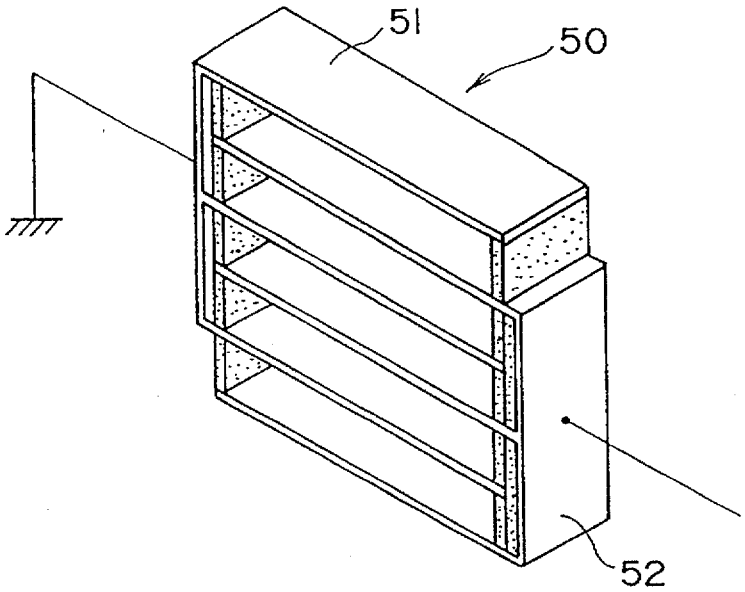
FIGS. 3A and 3B are perspective views showing the appearances of a deflecting electrode.
Figure 3B:
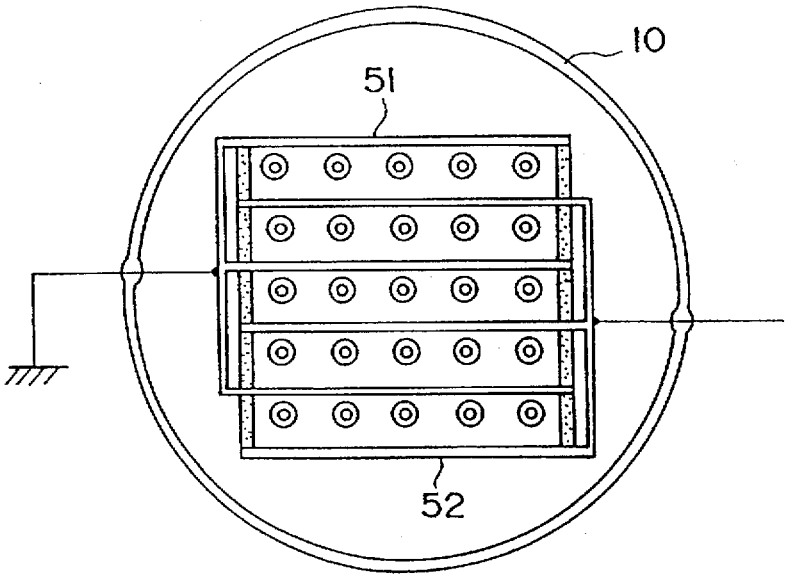

FIG. 3A is a perspective view showing the appearance of the deflecting electrode 50, and FIG. 3B is a plan view of the deflecting electrode 50 seen from the photocathode 22. As shown in FIG. 3A, the deflecting electrode 50 is that one pair of comb-like electrodes 51 and 52 are put alternately such that teeth of one comb are engaged with teeth of the other comb. The electrodes 51 and 52 are formed into a comb shape by placing deflecting plates having a 2 mm length in a direction of the tube-axis, a 120 mm length in a direction perpendicular to the direction of the tube-axis and a 0.1 mm thickness in parallel with a 0.5 mm spacing. In order to maintain the 0.5 mm spacing between the deflecting plates, insulating plates having a width of 0.4 mm and a height of 0.5 mm are put between the deflecting plates at both sides of the deflecting plates. Lead wires are taken out from the electrodes 51 and 52, and led out from the glass tube 10.

Further, as shown in FIG. 3B, the deflecting electrode 50 is positioned so that the apertures of the $G_1$ electrode 41, $G_2$ electrode 42 and $G_3$ electrode 43 are within the space between the deflecting plates of the electrodes 51 and 52. Therefore, in the case of looking through the photocathode 22, the deflecting electrode 50 does not disturb the sight of the apertures. That is, when photoelectrons are emitted from the photocathode 22 and go to the exit end, the deflecting electrode 50 is positioned such that it does not disturb the photoelectron beam running through the tube.

Figure 4:
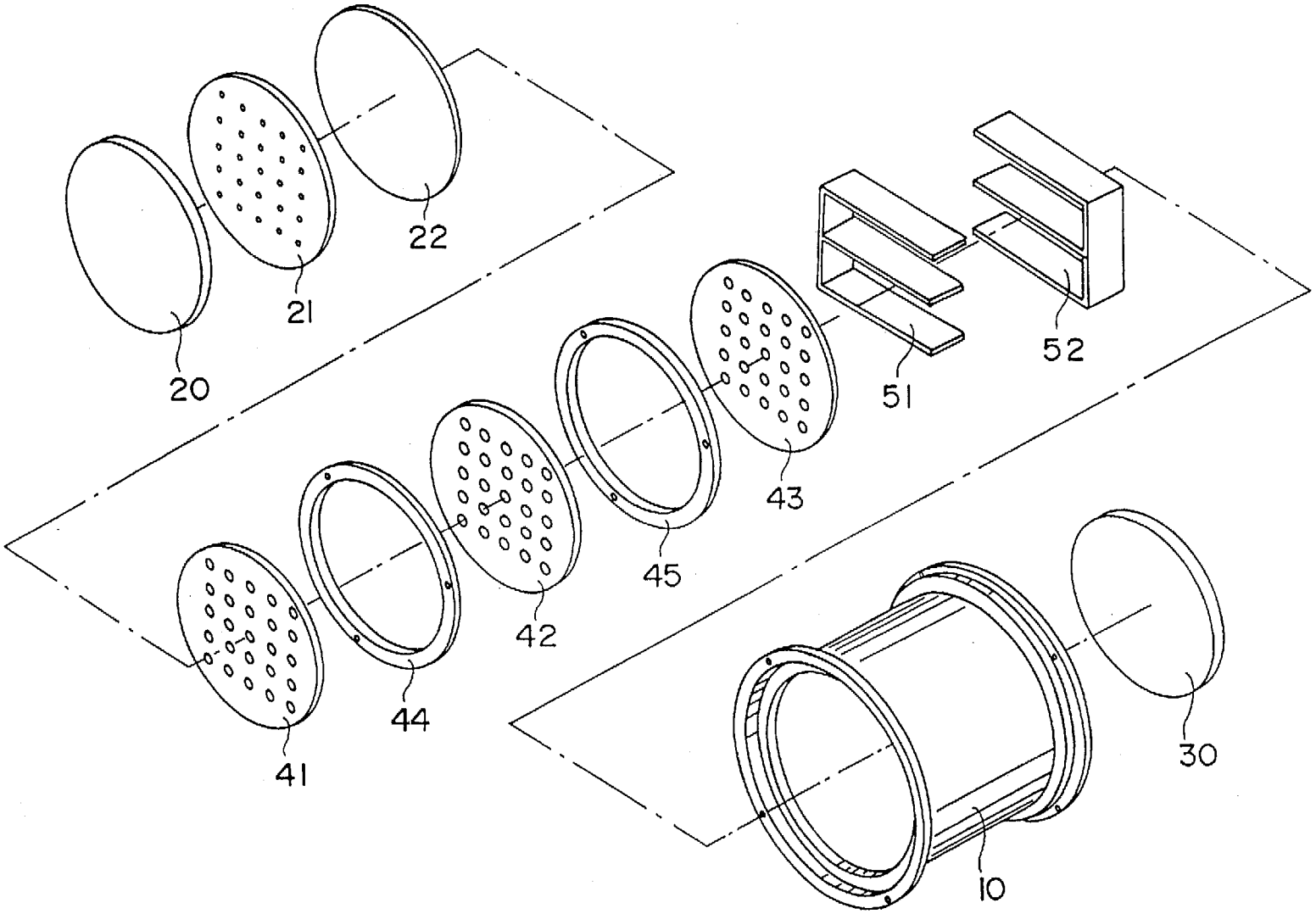
FIG. 4 is an exploded view of a streak tube according to the present embodiment.

FIG. 4 shows an exploded view of the streak tube of the present embodiment. As shown in FIG. 4, it is obvious that the streak tube is such that the number of parts, such as a micro-focusing electron lens 40 and a deflecting electrode 50, are contained in a short glass tube 10. Thus, if it is possible to minimize the total length of the streak tube, the running time of the photoelectron becomes short, and the blur due to the space-charge effect can be drastically reduced.

Figure 5:
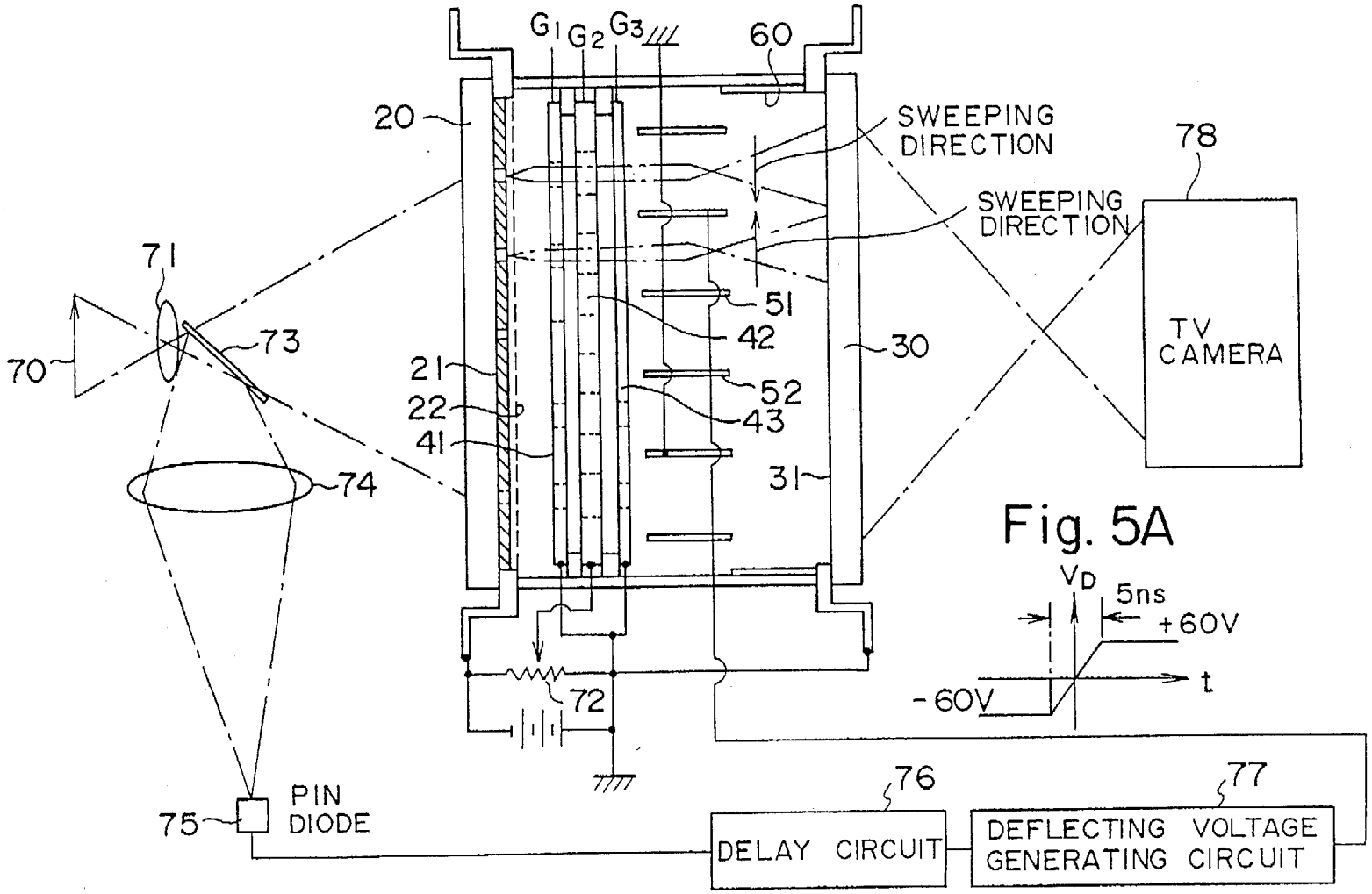
FIG. 5 is a plan view showing a configuration of a streak camera using a streak tube according to the present embodiment.

Next, FIG. 5 shows a configuration of a streak camera using the streak tube of the present embodiment. The operations of the present embodiment will be explained with the streak camera. First, an incident optical image 70' of an object 70 is formed on the photocathode 22 at the inside of the entrance window 20 through the optical lens 71. Since the optical mask 21 of an A1 layer is placed between the entrance window 20 and the photocathode 22, the divided micro optical spots for each pixel divided by the 200×200 apertures of the mask with the 0.5 mm spacing are formed on the photocathode 22. Since the size of the aperture is 20 μm, the photoelectrons are emitted only from the parts of the photocathode 22 corresponding to the 20 μm apertures. Then, the incident optical image of the object 70 is converted into a plurality of the divided micro-incident electronic images. In this case, it is not necessary to equal the horizontal space and the vertical space between the apertures.

The following D.C voltages are applied to the parts of the tube. First, −10 KV is applied to the photocathode 22, and 0 V (ground potential) is applied to the $G_1$ electrode 41 and the $G_3$ electrode 43. Further, the voltage from −10 KV to 0 V that each divided micro-incident electronic image on the photocathode 22 is re-formed on the phosphor screen 31 is applied to the $G_2$ electrode 42 by a variable resistor 72, and 0 V (ground potential) is applied to the wall electrode 60 and the phosphor screen 31. When these voltages are applied, the micro-focusing electron lens 40 is formed corresponding to each divided micro-incident electronic image on the photocathode 31, and the divided micro-incident electronic images are re-formed on the phosphor screen 31 as the divided micro-output electronic images arranged separately.

At the same time such processes flow, partial incident light enters a PIN diode 75 by a half-mirror 73, and generates a trigger signal. This trigger signal passes through a delay circuit 76, starts up a deflecting voltage generating circuit 77, and generates the inclined sweep voltage in this embodiment. The sweep voltage is applied to one electrode 52 of the deflecting electrode 50 and 0 V (ground potential) is applied to the other electrode 51, so that the divided micro-output electronic images are swept with the same spacing as the spacing of the divided images on the phosphor screen 31. Here, the amplitude of the inclined deflecting voltage is within a range that the swept images for pixels are not overlapped, and in this embodiment, it is adjusted within 0.5 mm which is the spacing between the pixels. For example, the applied voltage rises from −60 V to +60 V in 5 nanoseconds.

Then, a change of lightness of each pixel of the incident image is obtained on the phosphor screen 31 as the spatial distribution in the sweeping direction. In the present embodiment, sweeping is performed between the deflecting plates of the deflecting electrode 50 alternatively in opposite direction, so that the direction of the time axis is also opposite alternatively. The output optical image thus obtained is taken by a TV camera 78 and is analyzed, whereby the time-variation of the lightness distribution of the incident optical image can be known. In this embodiment, time resolution of approximately 1 nanosecond can be obtained. Note that instead of the TV camera 78, a camera may be installed and the object may be recorded on film.

Thus, in the present embodiment, sweeping width of the deflecting electrode 50 is narrow, so that the space between the photocathode 22 and the phosphor screen 31 can be extremely short, e.g., 26.5 mm, and the total length of the glass tube 10 becomes 45 mm. Further, the sweep voltage applied to the deflecting electrode 50 may be the inclined voltage, and it is necessary to be the step voltage.

Figure 6:
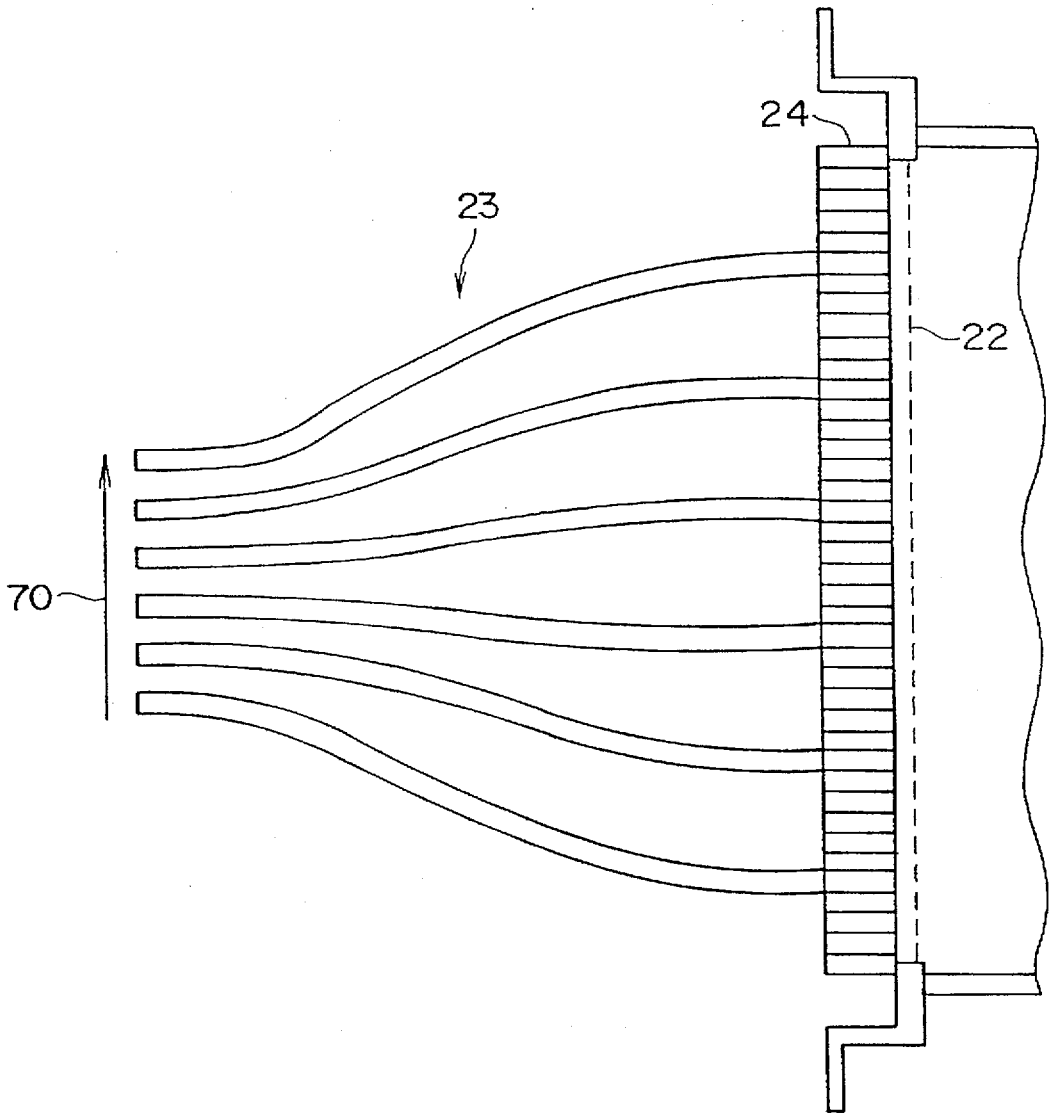
FIG. 6 is a view showing one embodiment that output ends of fiber cables are connected to a fiber plate in a matrix shape.

Next, a method of forming the divided micro-output electronic images will be explained. In a case of dividing the incident optical image into a plurality of pixels, there is a method that the optical mask 21 is placed on the side of the object 70 relative to the optical lens 71 and the images which have been divided into pixels are formed on the photocathode 22 by the optical lens 71. Further, as shown in FIG. 6, there is another method that a plurality of fiber cables 23 are placed near the object 70 and using a device that emitting ends of the fiber cables 23 are connected to a fiber plate 24 in a matrix shape, the incident optical image is divided into a plurality of pixels and guided to the photocathode 22.

Figure 7A:
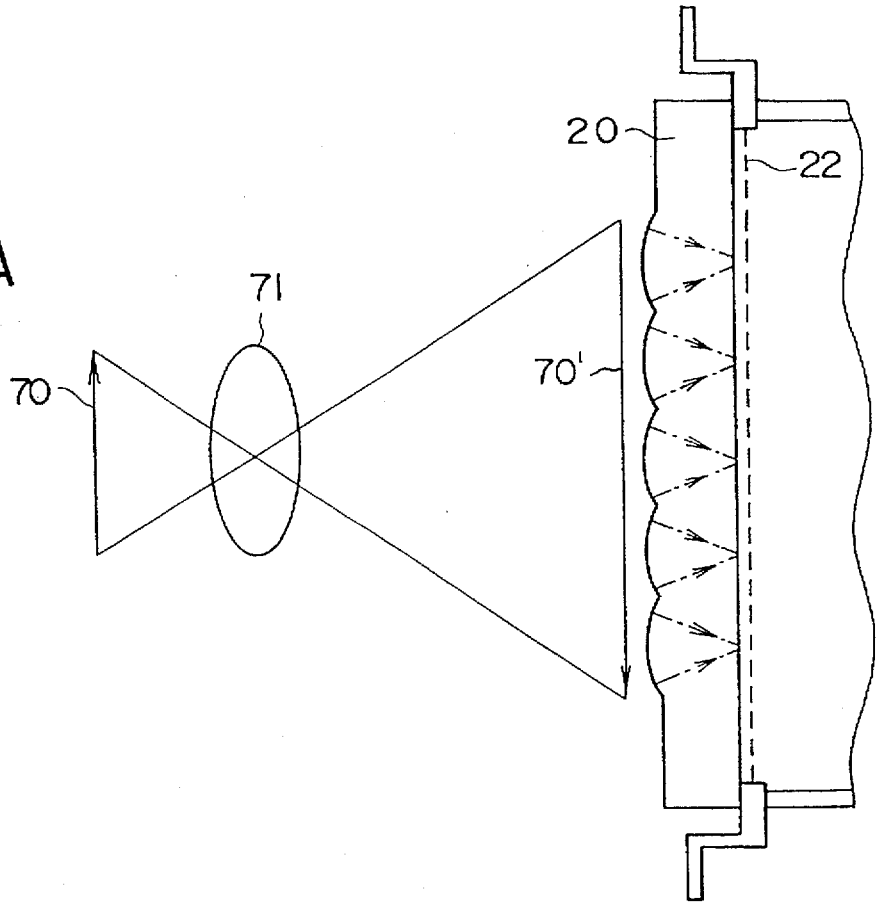
FIGS. 7A and 7B are views showing one embodiment that micro optical lenses are formed on an entrance window itself in a matrix shape.
Figure 7B:
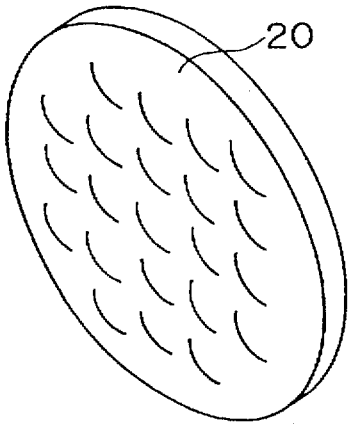
Figure 8A:
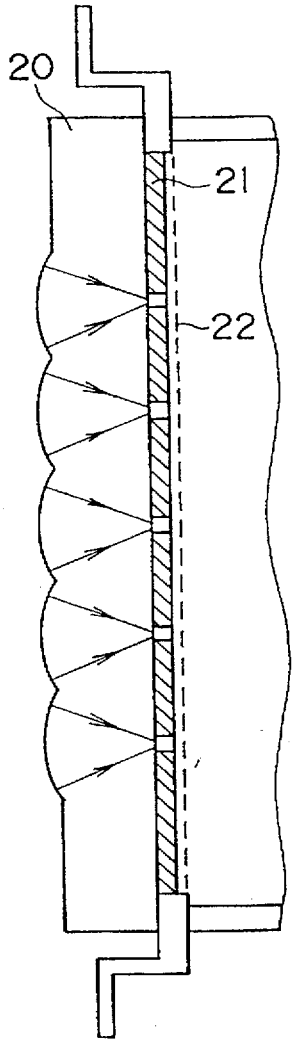
FIGS. 8A and 8B are views showing one embodiment of a combination of micro optical lenses and an optical mask having apertures holed in a matrix shape.
Figure 8B:
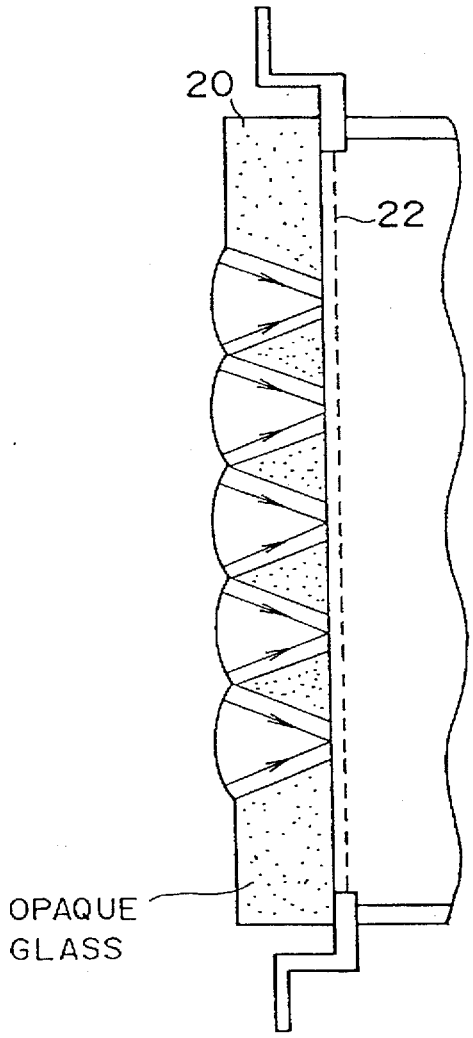

Further, as shown in FIGS. 7A and 7B, there is another method that micro-optical lenses are formed at the entrance window 20 itself in a matrix shape by using a micro-processing technique, and the incident light on each lens is focused to the micro-spot to be guided to the photocathode 22, whereby the divided micro-incident electronic images are formed. This method is an improvement on the problem of the optical mask 21, since the light except the light, passing through the apertures, is blocked by the mask, the light utilization factor is low. In this case, in order to get rid of crosstalk between pixels, as shown in FIG. 8A, the space between each micro-optical image formed by the micro-lenses may be masked by the Al layer. This is a combination of micro-lenses and the optical mask 21 with the apertures holed in a matrix shape, and as shown in FIG. 8B, the space between the micro lenses of the entrance window 20 may be an opaque glass.

Figure 9:
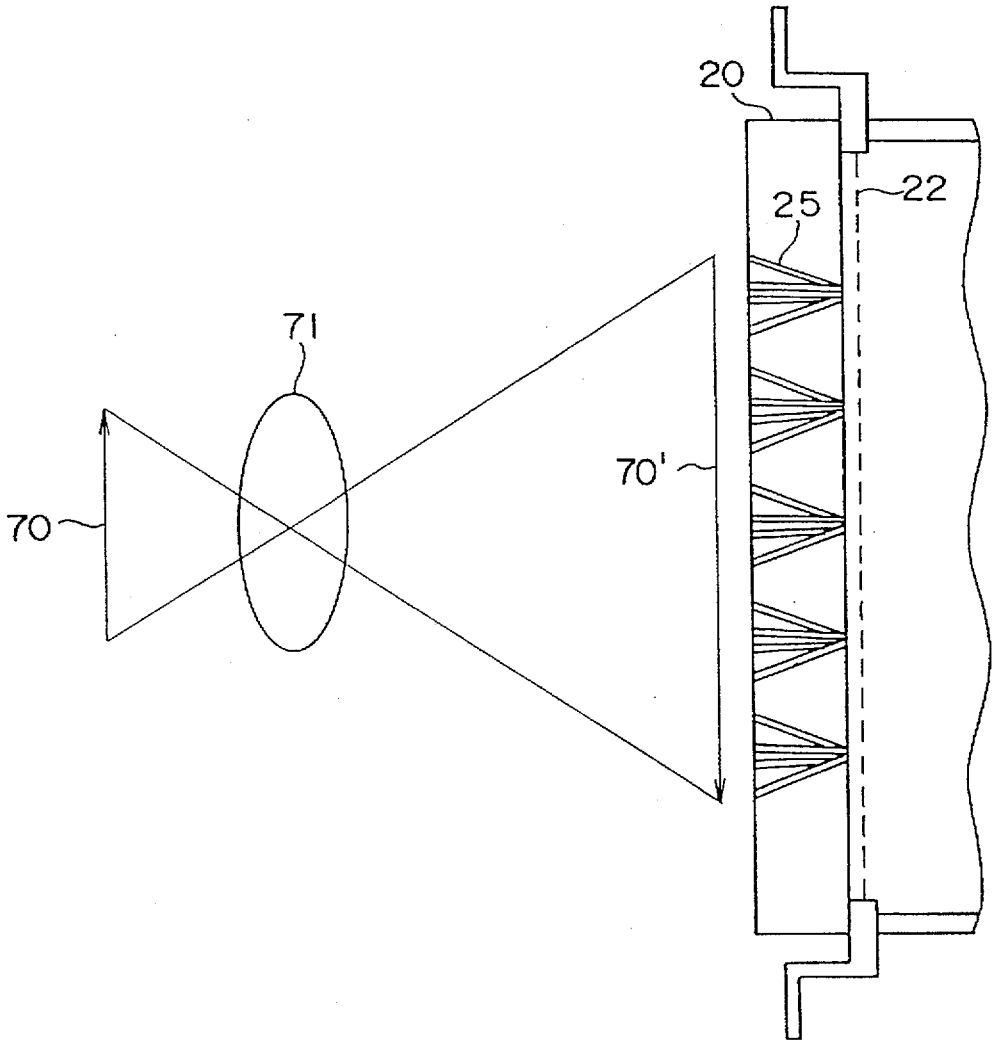
FIG. 9 is a view showing one embodiment that fibers are bedded in an entrance window and a reduced optical image is formed on a photocathode.
Figure 10:
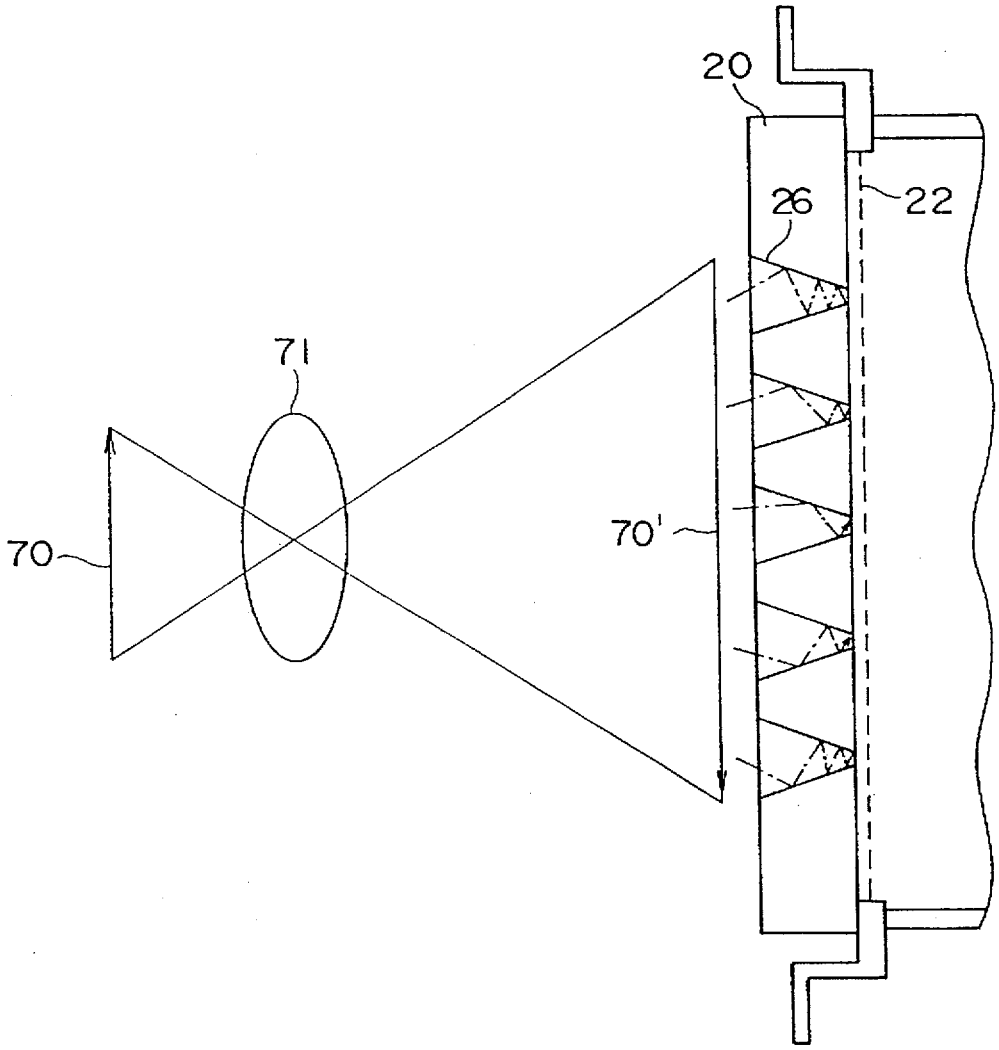
FIG. 10 is a view showing one embodiment that a metal plate is bedded in an entrance window and a light is reflected multiple times there and a reduced optical image is formed.

Alternatively, a method such as that shown in FIG. 9 may be used, where fiber groups are embedded into the entrance window 20 for each pixel, whereby the micro-optical images are formed on the photocathode. Likewise, as shown in FIG. 10, metal surfaces 26 may be embedded into the entrance window 20 to reflect light incident on the entrance window 20 toward the photocathode 22 so that micro-optical images are formed on the photocathode 22.

Figure 11:
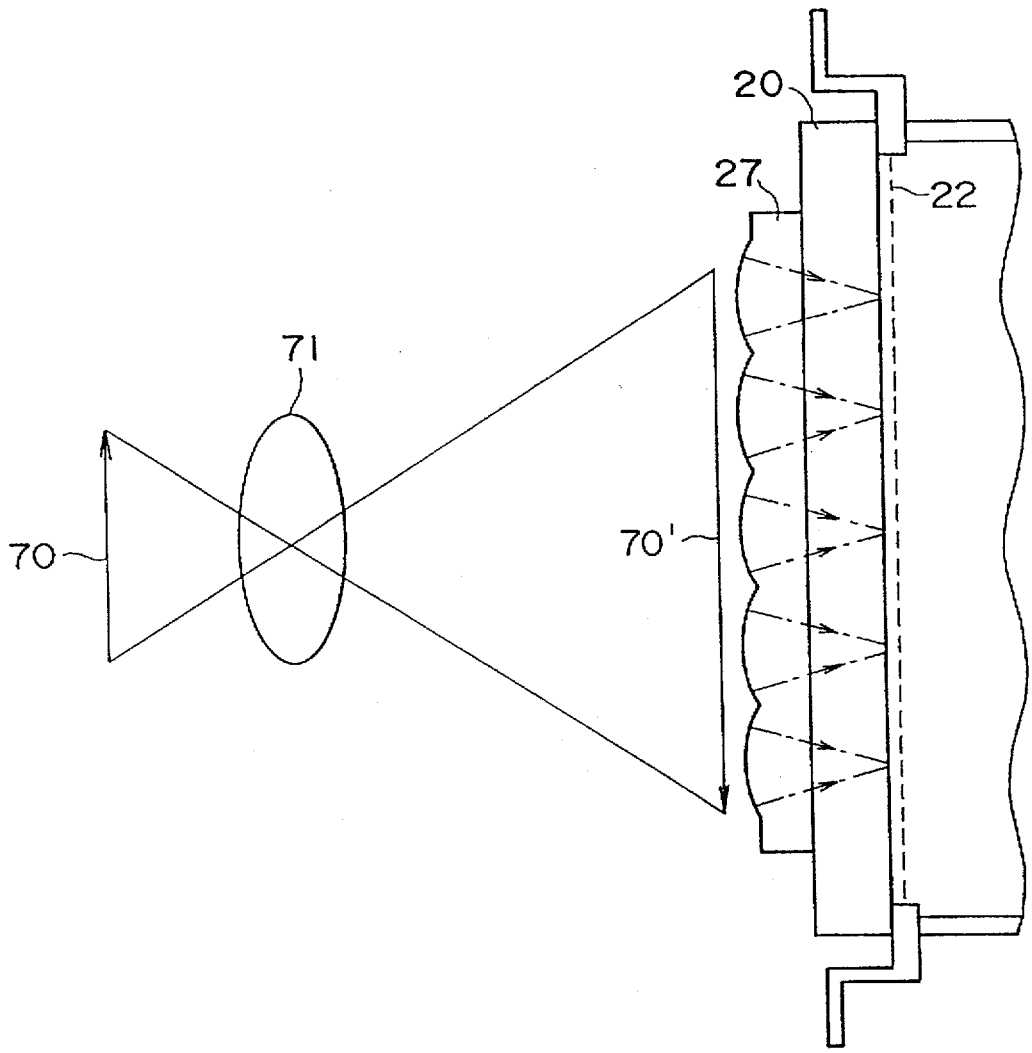
FIG. 11 is a view showing one embodiment that a plate in which micro lenses are formed is adhered to an entrance window.
Figure 12:
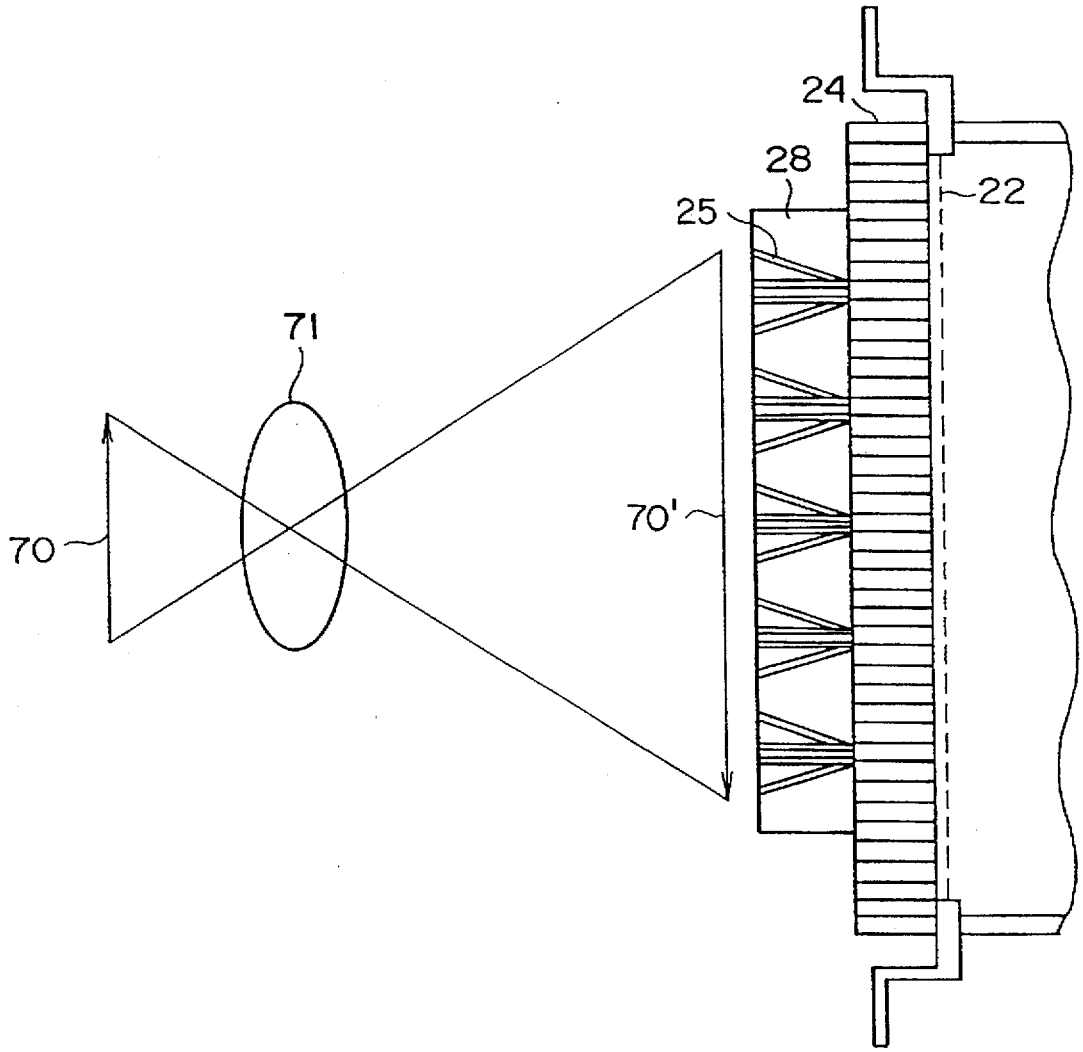
FIG. 12 is a view showing one embodiment that a plate in which fibers are bedded is adhered to a fiber plate.

Instead of directly forming the micro optical lenses on the entrance window 20 as shown in FIGS. 7A, 7B, 8A and 8B, a plate 27 in which micro-lenses are formed as shown in FIG. 11 may be adhered to the entrance window 20. Alternatively, a plate 28 into which fiber groups 25 are bedded for each pixel as shown in FIG. 12 may be adhered to the fiber plate 24.

Figure 13:
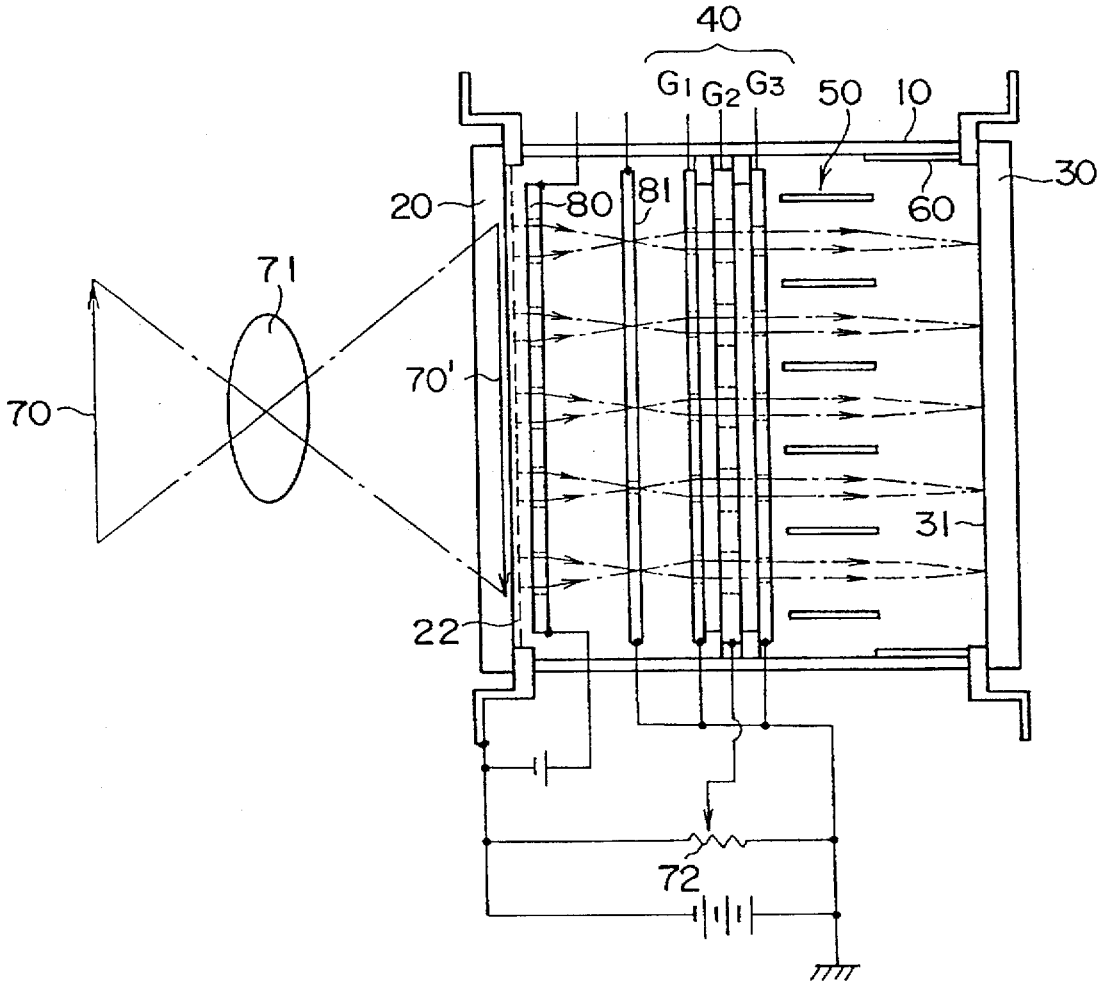
FIG. 13 is a plan view showing a streak tube using a collimating electrode and a mask electrode.

Next, FIG. 13 shows the embodiment of obtaining the divided micro-incident electronic images, by using the electron lens. As shown in FIG. 13, a collimating electrode 80 made of metal plates in which 0.18 mm diameter apertures are holed in a matrix shape with a 0.5 mm spacing is placed 0.5 mm apart from the photocathode 22, and further a mask electrode 81 in which 20 μm apertures are holed in a matrix shape with a 0.5 mm spacing is placed 3 mm apart from the collimating electrode 80. A micro-focusing electron lens 40 is placed in the rear of the mask electrode 81. In this case, centers of apertures of each electrode are aligned.

The −9.95 KV applied voltage close to the −10 Kv applied voltage to the photocathode 22 is applied to the collimating electrode 80, and 0 V (ground potential) is applied to the mask electrode 81. Further, 0 V (ground potential) is applied to the $G_1$ electrode 41 and the $G_3$ electrode 43, and the suitable voltage between −10 KV and 0 V is applied to the $G_2$ electrode 42 by adjusting the variable resistor 72. At this time, the photoelectron flow within a range of slightly greater than or equal to the 0.18 mm diameter aperture of the colimating electrode 80 among the photoelectrons emitted from the photocathode 22 is reduced (collimated) and goes toward the 20 μm apertures of the mask electrode 81 corresponding to the apertures of the collimating electrode 80 by the electron lens made of the mask electrode 81. In the mask electrode 81, some of photoelectrons are out of 20 μm apertures and absorbed by the mask electrode 81 but almost all of the photoelectrons pass through the apertures and go toward the output. Then, the divided micro incident electronic images are formed, and these are imaged on the phosphor screen 31 by the micro focusing electron lens 40.

In this case, one collimating electrode 80 is used but two collimating electrodes can be placed in order to improve the inflow efficiency of photoelectron to the apertures of the mask electrode 81. Further, the aperture of the collimating electrode 80 is shown as a circle but since the purpose of the collimating electrode 80 is to collect photoelectrons to the apertures of the mask electrode 81, the collimating electrode 80 is not limited to a bilateral symmetrical lens such as an imaging electron lens, so that the aperture of the collimating electrode 80 may be rectangular, square, or oval. Further, the mask electrode 81 and the $G_1$ electrode 41 may be adhered to join the two together.

Figure 14:
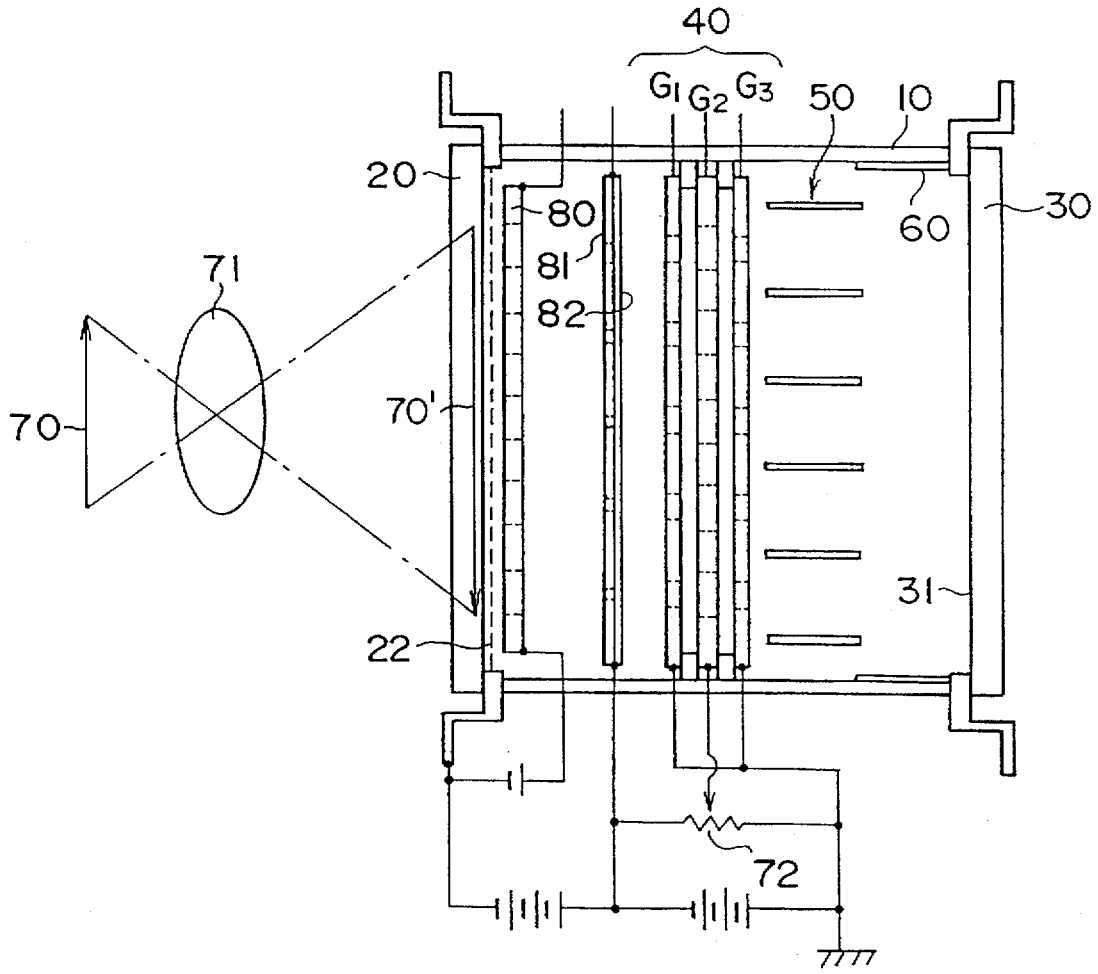
FIG. 14 is a plan view showing a streak tube in which a transparent electron multiplying dynode is put on an exit surface of a mask electrode.

FIG. 14 depicts a transparent electron multiplying dynode 82 of thin film, which is put on the surface of the exit side of the mask electrode 81 of FIG. 13. Photoelectrons passing through the apertures of the mask electrode 81 cause the multiplied secondary electrons emission to the exit side by the transparent electron multiplying dynode 82. Then, the divided micro-incident electronic images are formed, and they are imaged on the output surface by the micro focusing electron lens 40.

The −17.8 KV applied voltage close to the −18 KV applied voltage to the photocathode 22 is applied to the collimating electrode 80, and −10 KV is applied to the mask electrode 81 and the transparent electron multiplying dynode 82. Further, 0 V (ground potential) is applied to the $G_1$ electrode 41 and the $G_3$ electrode 43, and the suitable voltage between −10 KV and 0 V is applied to the $G_2$ electrode 42 by adjusting the variable resistor 72.

Figure 15:
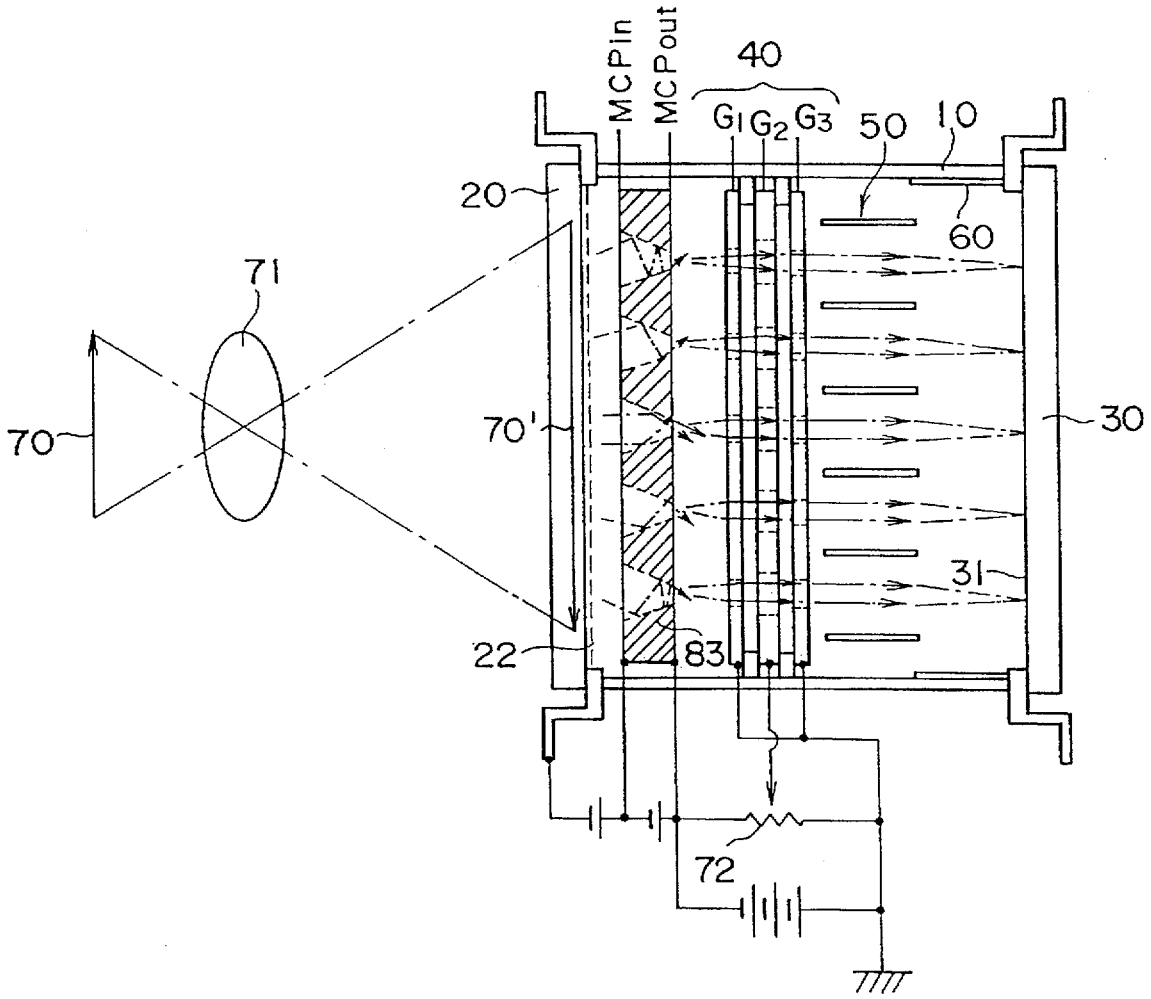
FIG. 15 is a plan view showing a streak tube using an MCP.

FIG. 15 shows the embodiment of forming the divided micro-incident electronic image by using a microchannel plate (MCP) 83 in which a plurality of continuous dynodes having apertures where the open entrances are bundled. A diameter of the apertures on the entrance side of the MCP 83 channel is 0.19 mm, and a diameter of the aperture on the exit side is 20 μm and a spacing is 0.5 mm and a length is 1.5 mm. The spacing between the photocathode 22 and the $MCP_{in}$ is 0.5 mm, and the spacing between the $MCP_{out}$ and the micro focusing electron lens 40 is 1.5 mm.

−12 KV is applied to the photocathode 22 and −11.5 KV is applied to the $MCP_{in}$ and −10 KV is applied to the $MCP_{out}$. Further, 0 V (ground potential) is applied to the $G_1$ electrode 41 and the $G_3$ electrode 43, and the suitable voltage between −10 KV and 0 V is applied to the electrode 42 by adjusting the variable resister 72.

Photoelectrons are emitted corresponding to the optical images formed on the photocathode 22. The photoelectrons enter the $MCP_{in}$ and move toward the $MCP_{out}$ while being multiplied. As the channel of the MCP 83 tapers, the photoelectrons are reduced to a 20 μm diameter at the $MCP_{out}$ and emitted to the exit side. Then, the divided micro incident electronic images are formed. These electronic images are imaged on the phosphor screen 31 by the micro-focusing electron lens 40.

Figure 16:
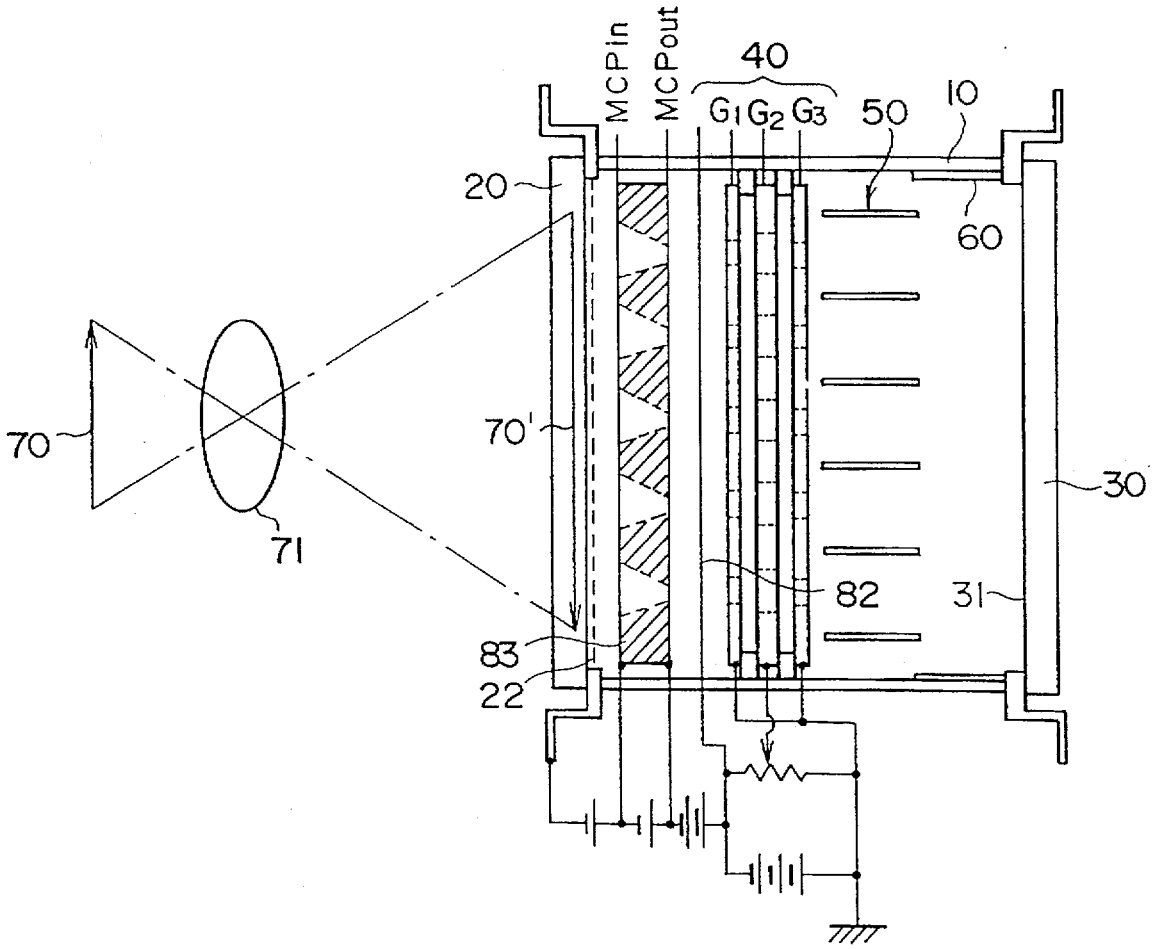
FIG. 16 is a plan view showing a steak tube using an MCP and a transparent electron multiplying dynode.

Alternatively, as shown in FIG. 16, the transparent electron multiplying dynode 82 may be placed in the rear of the MCP 83, and the divided micro incident electronic images generated by the MCP 83 output are incident on the transparent electron multiplying dynode 82 and multiplied, and then imaged on the phosphor screen 31 by the micro-focusing electron lens 40.

Next, the alternative embodiments of the micro-focusing electron lens 40 will be described. The micro-focusing electron lens 40 of this embodiment is a unipotential lens where the applied voltage to the $G_1$ electrode 41 is the same as the voltage of the $G_3$ electrode 43. The voltage of the $G_2$ electrode 42 is less than this applied voltage (negative) but the electrode 42 may be a unipotential lens with the voltage of the $G_2$ electrode 42 being higher than the voltage (positive) of the $G_1$ electrode 41 and the $G_3$ electrode 43. Further, the voltage of the $G_1$ electrode 41 is not limited to the same voltage as the $G_3$ electrode 43. For example, it is possible that the voltage is −5 KV to $G_1$ electrode 41 and 0 V to $G_3$ electrode 43. That is, any one of the electrodes can be used if it is used in the imaging electron lens, and the electrode is reduced in size and arrayed into a matrix shape with a predetermined spacing.

Figure 17:
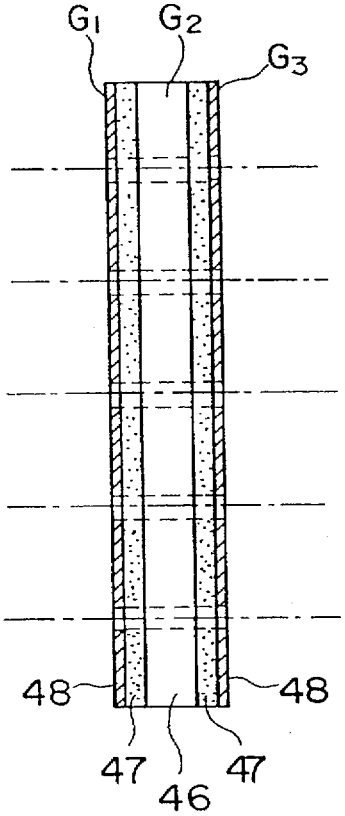
FIG. 17 is a sectional view showing one alternative embodiment of a micro-focusing electron lens.

Further, in the embodiment as shown in FIG. 2, the $G_1$ electrode 41, the $G_2$ electrode 42, and the $G_3$ electrode 43 are prepared individually, and they are piled up through the insulating rings 44 and 45, but, for example, using the manufacturing procedure of the micro-electronic tube, the electrodes may be formed on the same Si substrate as shown in FIG. 17. Here, a 10 μm thick $SiO_2$ film 47 is formed on both sides of a 1 mm thick Si substrate 46, and thereafter 0.18 mm apertures are holed in a matrix shape with a 0.5 mm spacing by etching, and a 5000 Å Al layer 48 is further deposited on both sides of the Si substrate 46, whereby the $G_1$ electrode, the $G_2$ electrode, and the $G_3$ electrode are formed.

Figure 18:
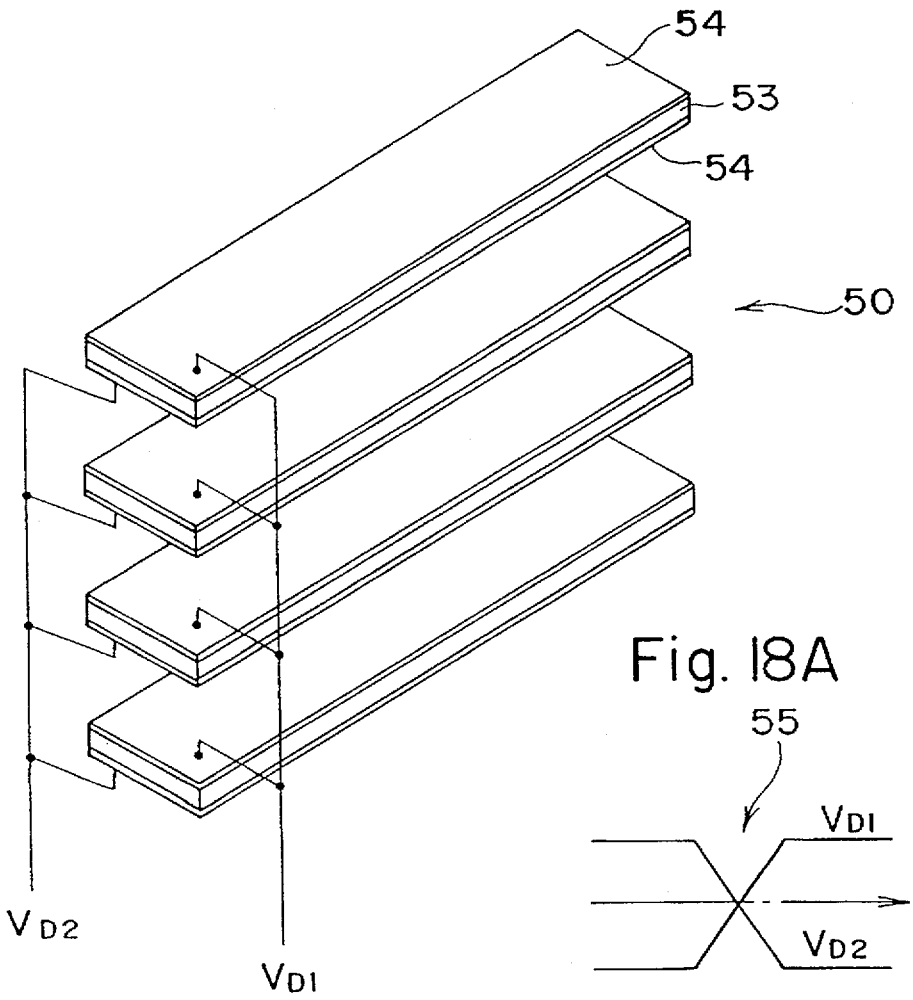
FIG. 18 is a perspective view showing another embodiment of deflecting electrode.
Figure 18A:
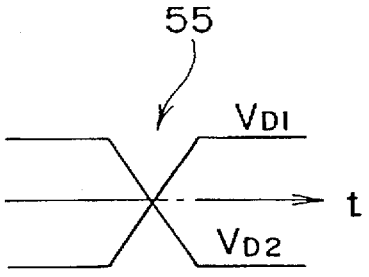
FIG. 18A is a graphic representation of the push-pull deflecting voltage applied to loads of the deflecting plates.

FIG. 18 is a perspective view showing the alternative embodiment of the deflecting electrode 50. A 0.2 mm thick ceramic plate 53 is made into a 110 mm×2 mm rectangle and an Al layer 54 is deposited on both surfaces thereof, whereby a deflecting plate is formed. Then, as shown in FIG. 18, the upper surface of each plate is electrically connected to each other and the bottom surface thereof is also electrically connected to each other, and the connections are taking to the outside of the tube as two leads, and the push-pull deflecting voltage 55 as shown in FIG. 18A is applied to these leads. If such a deflecting voltage 55 is applied, each divided micro-output electronic image is swept on the phosphor screen 31 in the same direction. Further, the deflecting plates are not required to have a 0.5 mm spacing, but rather the spacing can be a 1 mm spacing or 1.5 mm spacing and the micro-output electronic images within a range of the spacing may be swept together.

Figure 19A:
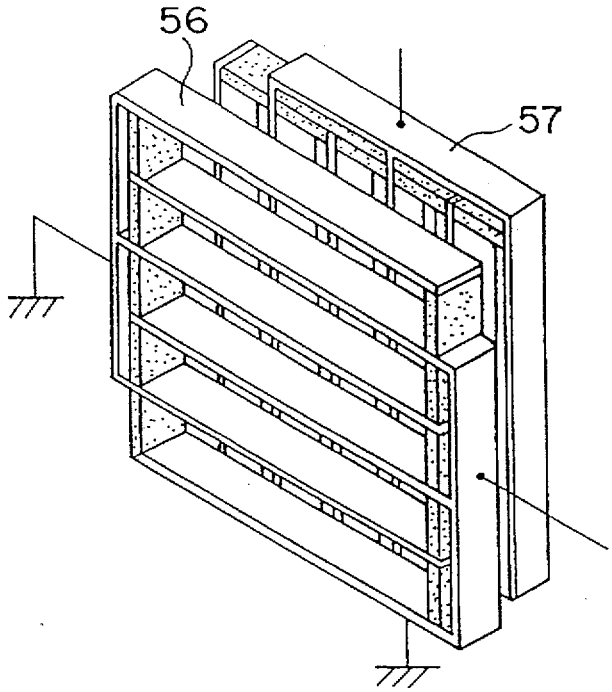
FIGS. 19A and 19B are perspective views showing one embodiment of placing deflecting electrodes into a matrix shape.
Figure 19B:
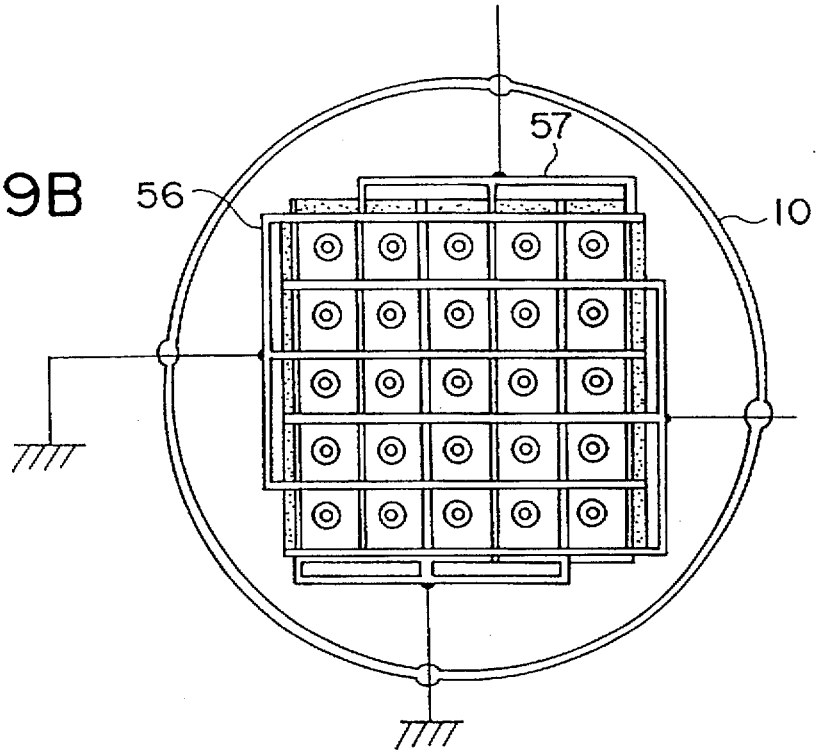
Figure 20:
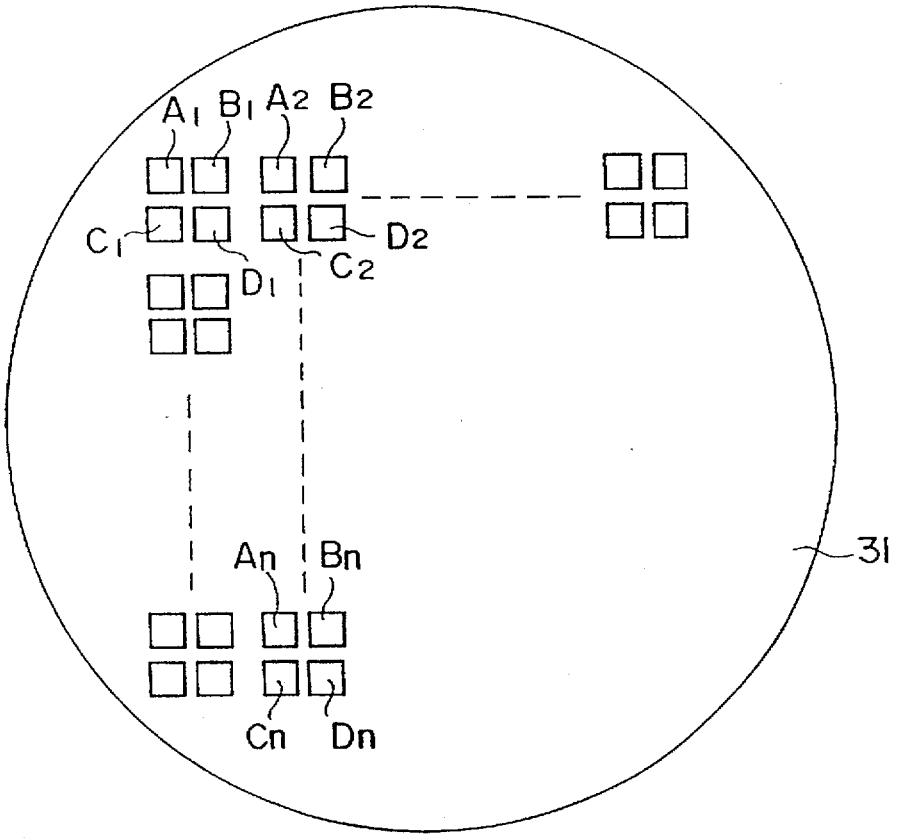
FIG. 20 is a plan view showing an output optical image obtained on a phosphor screen.

Alternatively, as shown in FIGS. 19A and 19B, another pair of deflecting electrodes 57 are placed in the rear of one pair of the deflecting electrodes 56, and the step voltage is applied to each pair, whereby the time series output optical image corresponding to each divided micro-incident electronic image such as $A_n$, $B_n$, $C_n$, and $D_n$ can be obtained on the phosphor screen 31. The output optical image is shown in FIG. 20.

Figure 21:
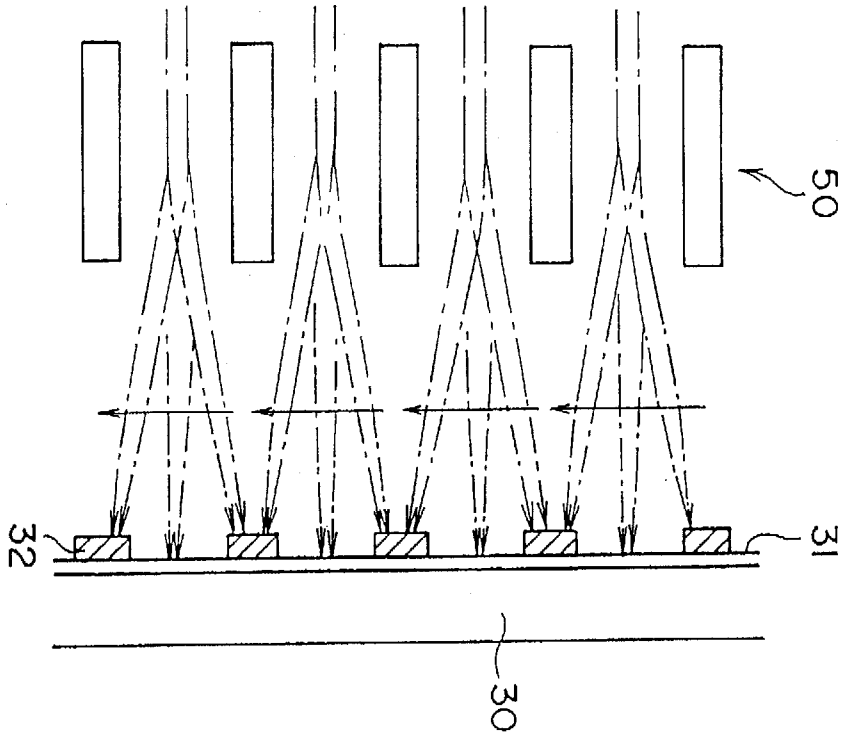
FIG. 21 is a plan view showing one embodiment of placing a thick Al layer on a phosphor screen.
Figure 22:
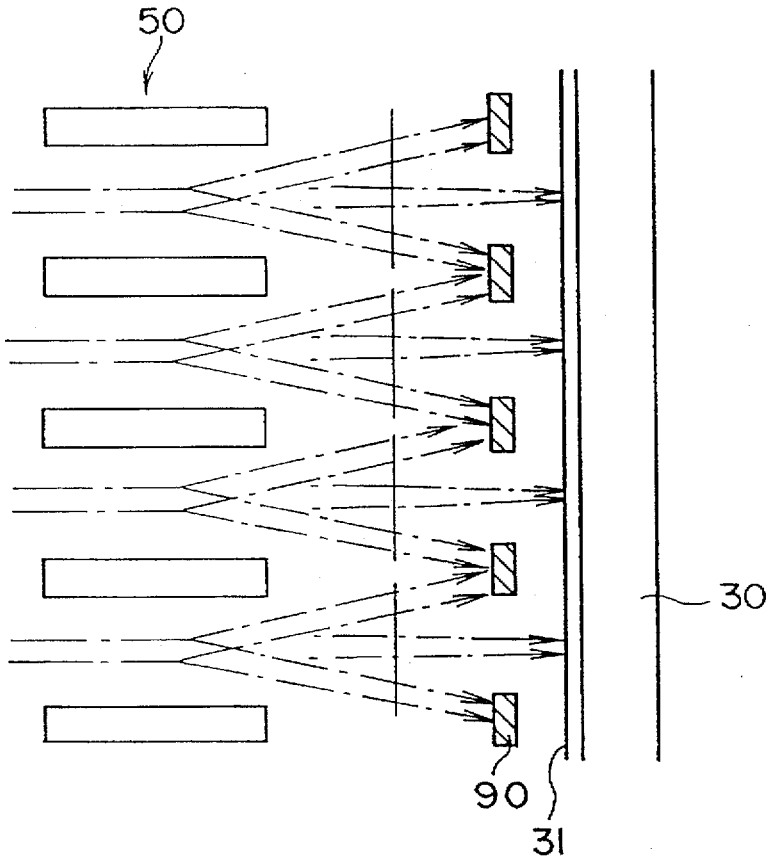
FIG. 22 is a plan view showing one embodiment of placing a stripe-shaped electrode between deflecting electrodes and a phosphor screen.

FIG. 21 shows a phosphor screen 31 on which a stripe-shaped 2–3 micron thick Al layer 32 is placed at the location of the electron beams standing by. In the case where the divided micro-output electronic images are swept, if the illuminating image generates on the phosphor screen 31 in the stand-by state before and after sweeping, the background increases, so that the Al thick layer 32 prevents the phosphor screen 31 at the location of the electron beams standing by from illuminating. Further, as an alternative example, as shown in FIG. 22, stripe-shaped electrodes 90 where are preferably 0.1 mm thick, may be placed between the deflecting electrode 50 and the phosphor screen 31.

Figure 23:
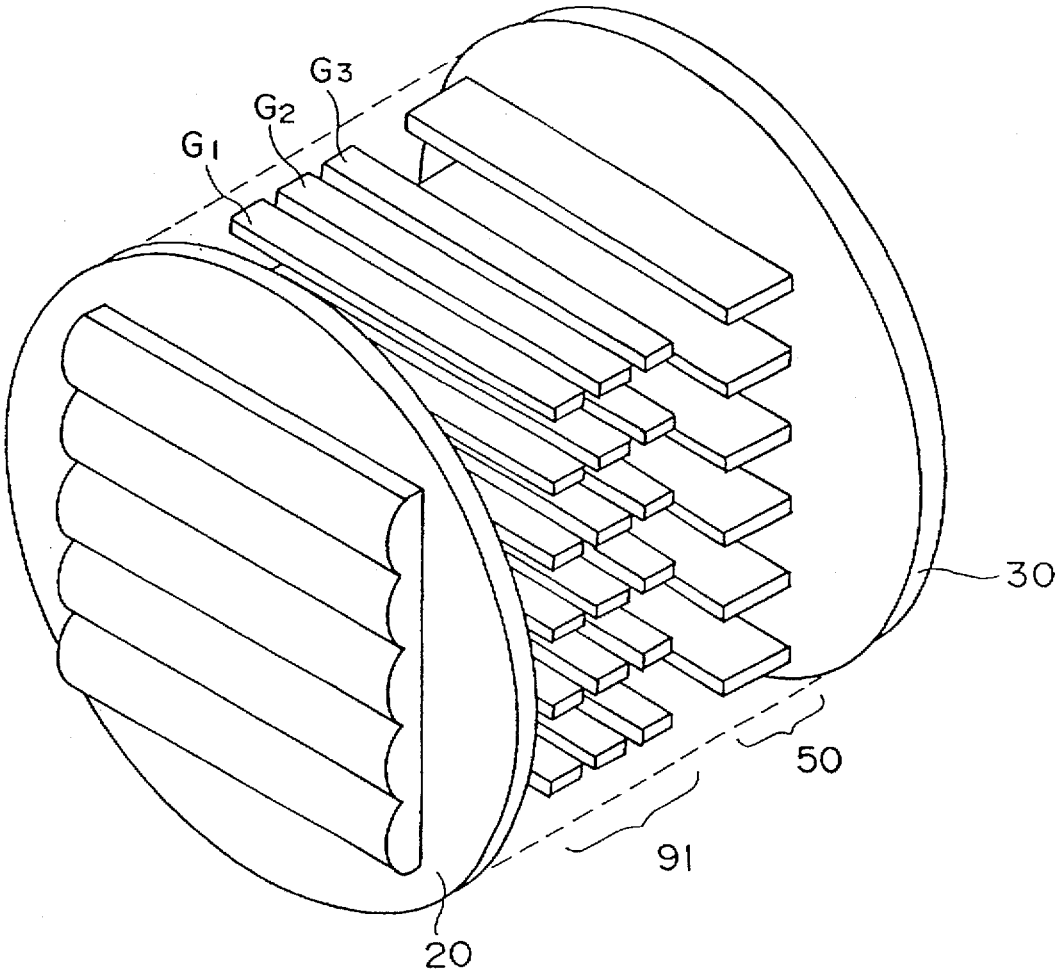
FIG. 23 is a view showing one embodiment that a surface of an entrance window is of semi-cylindrical shape.
Figure 24:
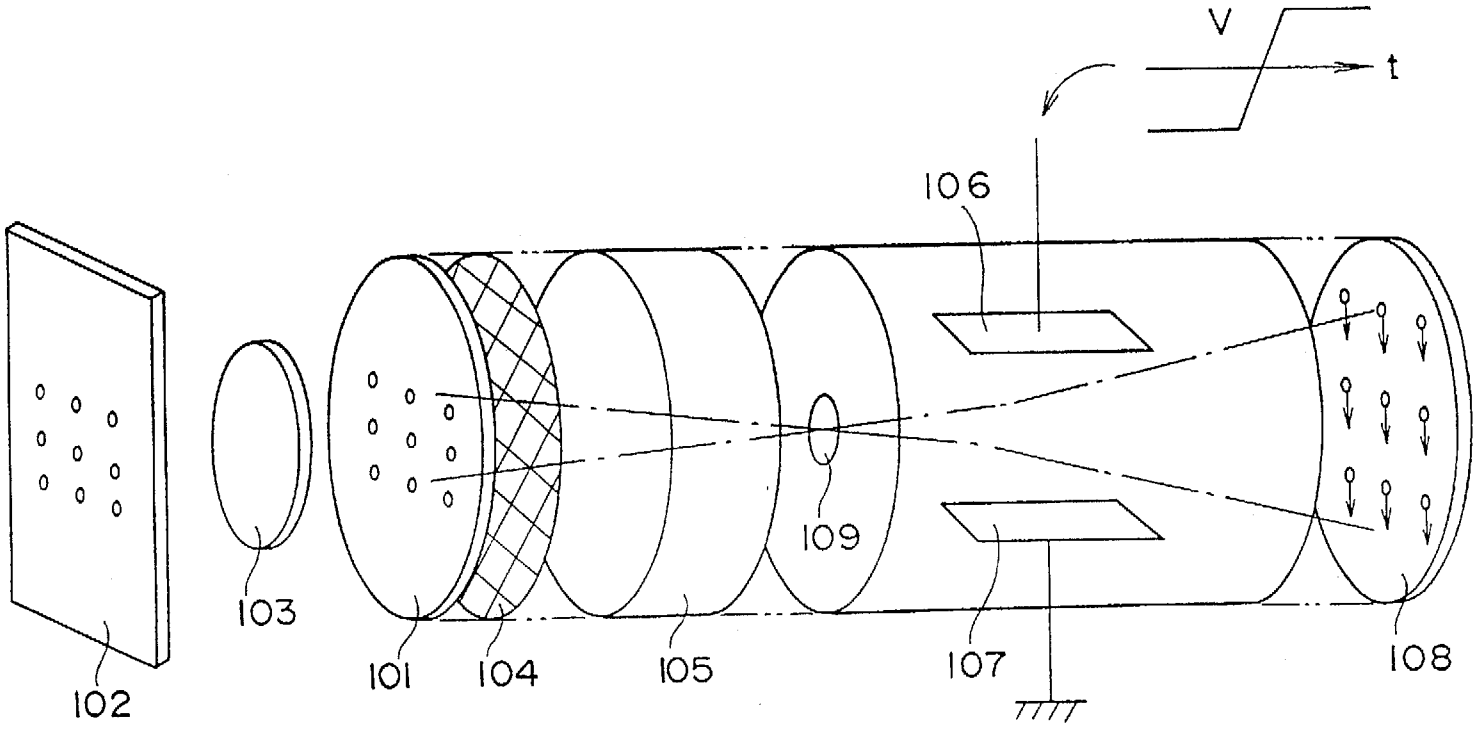
Fig. 24 (PRIOR ART)
FIG. 24 is a view showing a configuration of a conventional streak tube.
Figures 25, 25A:
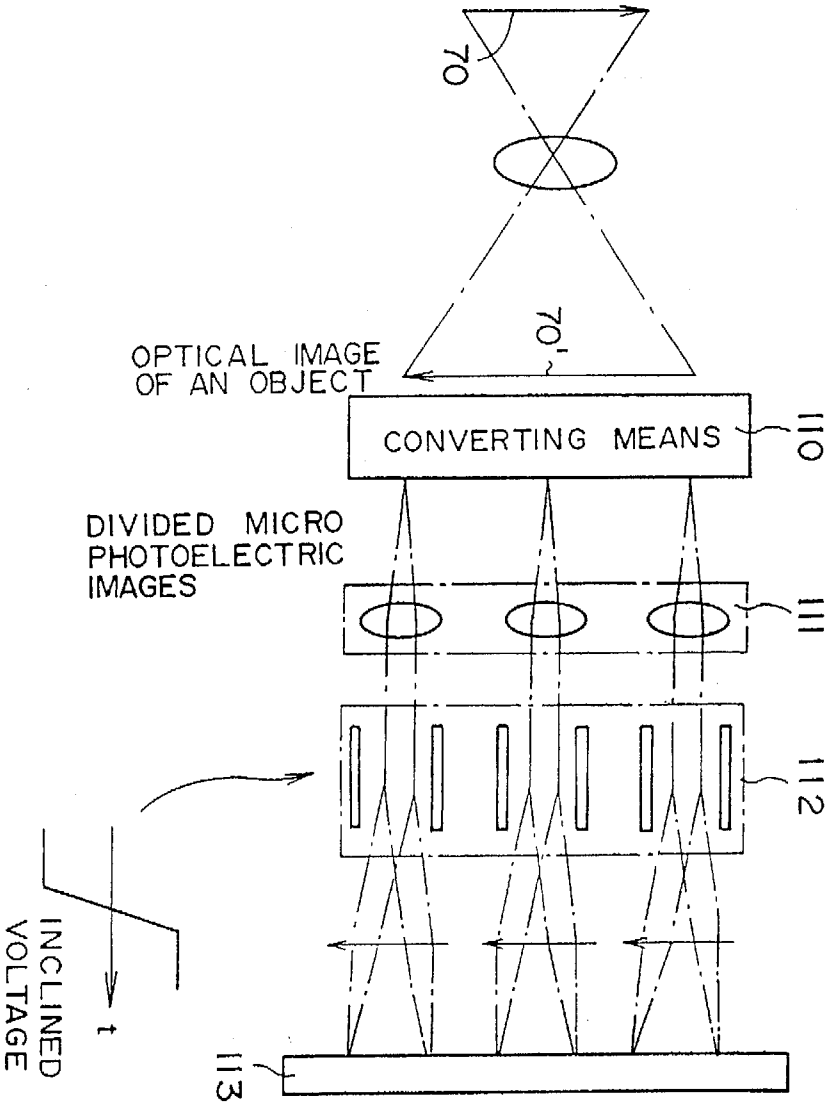
FIG. 25 is a view showing a basic principle of the present invention.
FIG. 25A is a voltage diagram illustrating a voltage to be applied to the streak tube of FIG. 25.
Figure 26:
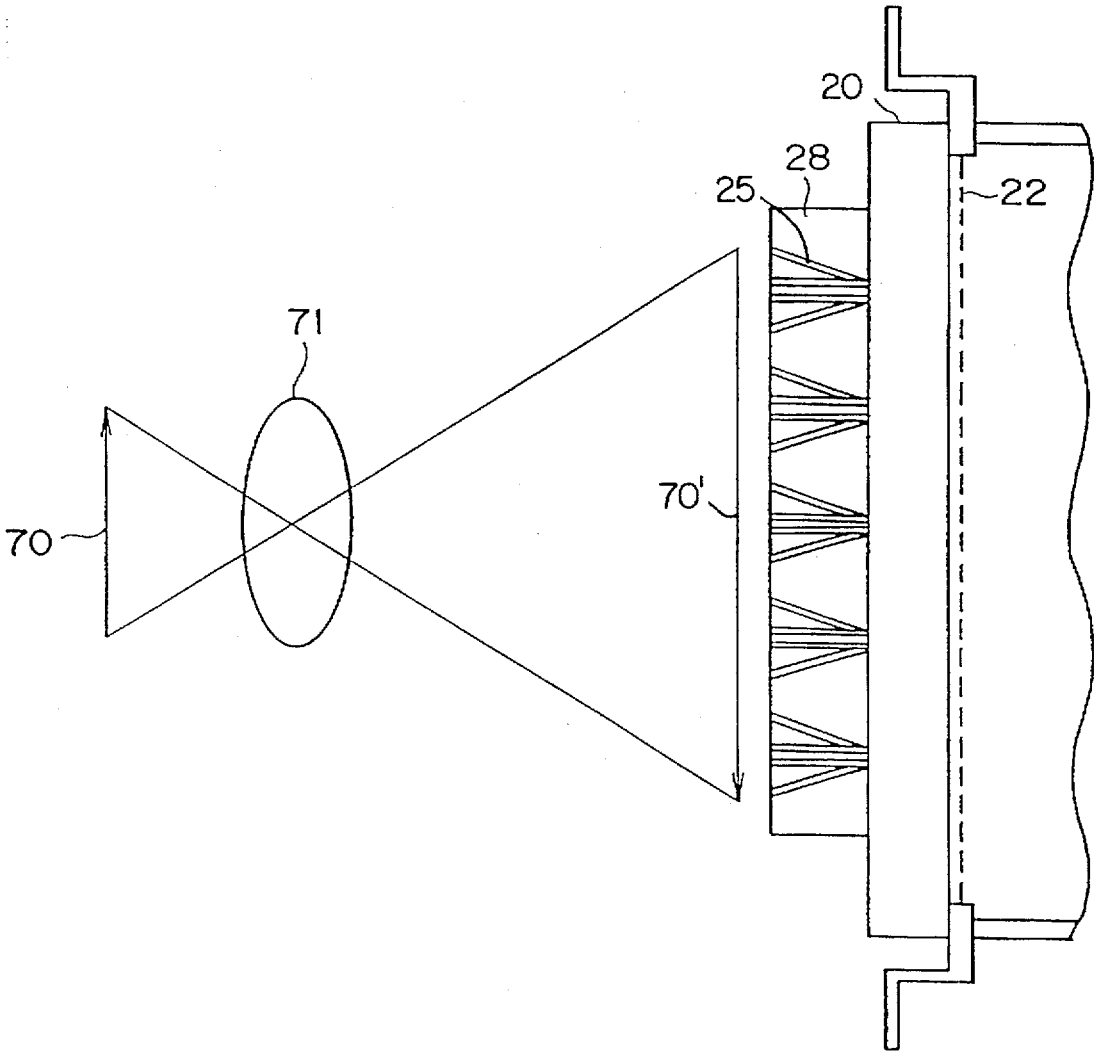
FIG. 26 is a view showing an embodiment where a plate in which fibers are embedded is attached to an entrance window.

Further, in the above-described embodiments, the micro-focusing electron lenses 40 are arrayed into a matrix shape, but in a case of measuring a spectrum from a spectroscope, the micro-focusing lens is not required to be two-dimensional. Accordingly, as shown in FIG. 23, the surface of the entrance window 20 is a semi-cylindrical lens and a one-dimensional arrayed micro focusing electron lens 91 may be used.

Note that in the explanation of the present embodiments, the spacing of the arrayed micro-optical lenses and the micro-focusing electron lenses in a matrix shape is 0.5 mm but the spacing may be 0.3 mm, 0.2 mm or some other value, and in accordance with the spacing, the spacing of the deflecting plates similar to a strip of paper may also be altered. Further, diameter of the apertures of the $G_1$ electrode 41, the $G_2$ electrode 42, and the $G_3$ electrode 43 can be varied to many values.

Further, in the present embodiment, the output image is detected by using the phosphor screen 31, but it can be read by a device that a solid pickup device such as an electron implantation CCD is placed in a tube or by arraying multi-anodes. Further, the MCP may be placed in front of the phosphor screen 31 to multiply the photoelectrons.

Further, when the divided micro-output electronic images are swept on the phosphor screen 31 as shown in FIG. 21 or FIG. 22, it is not required that a sweeping surface is a time axis, but all signals in a sweeping direction can be integrated and used. In this case, one step image is obtained and it works as a shutter camera.

Further, in a case of a repetition phenomenon, in synchronization with the repetition, the sweeping is repeated and the image is integrated by the camera or the TV camera, whereby the SN is improved. This is the same as the conventional streak camera. In such a case, the sinusoidal voltage may be applied as the sweeping voltage.

According to a streak tube of the present invention, an optical image of an object is converted into a plurality of divided micro-incident electronic images, and photoelectrons from the divided micro-incident electronic images are focused by a focusing electron lens. The micro-incident images are further swept by a deflecting means and are imaged on an output plane. Thus, the optical image of the object is converted into the divided micro-incident electronic images, so that focusing and sweeping can be performed in the short distance. Accordingly, the total length of the tube can be short.

Further, since the total length of the tube can be short, the running time of the photoelectrons is short, so that the blur due to the space-charge effect can be reduced.

Further, the intersections of the photoelectrons corresponding to the total incident optical image are eliminated (in each divided micro-incident electronic image, there is the intersection but the density is low), so that the blur due to the space-charge effect can be reduced.

Moreover, the location of the each pixel of the output image is determined by the arrangement of the divided components, so that geometrical distortion of the output image corresponding to the incident optical image does not occur.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A streak tube comprising:

converting means for converting an optical image into first and second divided micro-incident electronic spots, which are separated from one another by a predetermined space, said optical image being formed on said converting means by a light beam from a target object, and each electronic spot being treated as a point;

a first focusing electron lens comprising a plurality of focusing electrode plates, each having an aperture, said focusing electrode plates being joined with one another in a state where said apertures of said focusing electrode plates are aligned, and said first focusing electron lens focuses electrons from said first divided micro-incident electronic spot by making the electrons pass through the apertures;

a second focusing electron lens comprising a plurality of focusing electrode plates each having an aperture, said focusing electrode plates being joined with one another in a state where said apertures of said focusing electrode plates are aligned, and said second focusing electron lens focuses electrons from said second divided micro-incident electronic spot by making the electrons pass through the apertures;

deflecting means comprising first and second deflecting electrodes, said first and second deflecting electrodes both have a comb-like shape, with teeth parts of said first deflecting electrode respectively facing teeth parts of said second deflecting electrode, with voltage between said first and second deflecting electrodes changing with the lapse of time, and said deflecting means deflecting a direction of movement of electrons from said first and second focusing electron lenses simultaneously by transmitting the electrons between the teeth of said first and second deflecting electrodes; and an output plane for imaging electrons passing through said deflecting means, image points on said output plane being formed by said electrons passing through said deflecting means, said electrons being swept by said deflecting means within an area that corresponds to said predetermined space.

2. A streak tube according to claim 1, wherein said converting means comprises dividing means for dividing the optical image of the object into a plurality of divided micro-optical images, and a photocathode for converting each divided micro-optical image divided by said dividing means into a corresponding divided micro-incident electronic spot.

3. A streak tube according to claim 2, wherein said dividing means comprises a plurality of fiber cables placed near said object and a fiber plate to which emitting ends of said fiber cables are connected.

4. A streak tube according to claim 2, wherein said dividing means comprises micro-optical lenses formed at an entrance window of the streak tube.

5. A streak tube according to claim 2, wherein said dividing means comprises fiber groups bedded into an entrance window of the streak tube.

6. A streak tube according to claim 2, wherein said dividing means comprises metal plates bedded into an entrance window of the streak tube having mirrored surfaces of which to reflect the light multiple times.

7. A streak tube according to claim 2, wherein said dividing means comprises a plate adhered to an entrance window of the streak tube in which micro-lenses are formed.

8. A streak tube according to claim 2, wherein said dividing means comprises a plate adhered to an entrance window of the streak tube into which fiber groups are embedded.

9. A streak tube according to claim 1, wherein said converting means comprises a photocathode for converting the optical image of the object into photoelectrons, and dividing means for dividing the photoelectrons emitted from said photocathode into a plurality of divided micro-incident electronic spots.

10. A streak tube according to claim 9, wherein said dividing means comprises an electron lens including a collimating electrode placed behind said photocathode and a mask electrode placed behind said collimating electrode.

11. A streak tube according to claim 10, further comprising a transparent electron multiplying dynode adjacent a surface of said mask electrode.

12. A streak tube according to claim 9, wherein said dividing means comprises a microchannel plate placed in the rear of said photocathode.

13. A streak tube according to claim 12, further comprising a transparent electron multiplying dynode placed behind said microchannel plate.

14. A streak tube according to claim 1, wherein a number of spaces between the teeth of said two deflecting electrodes is less than a number of rows of apertures of said focusing electron lens.

15. A streak tube according to claim 1, wherein a region of said output plane equivalent to the location of each divided micro-output electronic spot standing by for sweep is covered by aluminum.

16. A streak tube according to claim 1, further comprising stripe-shaped electrodes placed between said deflecting means and said output plane, said stripe-shaped electrodes being positioned at a location of each divided micro-output electronic spot standing by for sweep.

17. A streak tube according to claim 1, wherein said first focusing electron lens is formed by serially depositing a first metal layer, a first insulating layer, a second metal layer, a second insulating layer and a third metal layer.

* * * * *